US010131157B2

(12) United States Patent
Ashizawa et al.

(10) Patent No.: US 10,131,157 B2
(45) Date of Patent: Nov. 20, 2018

(54) IMAGE FORMING APPARATUS, RECORDING MEDIUM AND IMAGE FORMING SYSTEM

(71) Applicants: Katsuhisa Ashizawa, Yamanashi-ken (JP); Hiroshi Mochizuki, Yamanashi-ken (JP)

(72) Inventors: Katsuhisa Ashizawa, Yamanashi-ken (JP); Hiroshi Mochizuki, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/850,930

(22) Filed: Dec. 21, 2017

(65) Prior Publication Data

US 2018/0178546 A1 Jun. 28, 2018

(51) Int. Cl.

| | |
|---|---|
| ***B41J 2/325*** | (2006.01) |
| ***B41J 2/36*** | (2006.01) |
| ***B41J 17/02*** | (2006.01) |
| ***B41J 11/42*** | (2006.01) |

(52) U.S. Cl.
CPC ..... *B41J 2/325* (2013.01); *B41J 11/42* (2013.01); *B41J 17/02* (2013.01)

(58) Field of Classification Search
CPC ... B41J 2/325; B41J 11/42; B41J 17/02; B41J 2/36; B41J 2/362
See application file for complete search history.

(56) References Cited

U.S. PATENT DOCUMENTS

| | | | | |
|---|---|---|---|---|
| 6,088,048 | A * | 7/2000 | Soshi | B41J 17/36 347/188 |
| 6,313,857 | B1 * | 11/2001 | Shimizu | B41J 2/36 347/188 |
| 2001/0010535 | A1 * | 8/2001 | Andoh | B41J 2/325 347/213 |
| 2015/0035932 | A1 * | 2/2015 | Aihara | B41J 2/325 347/213 |

FOREIGN PATENT DOCUMENTS

| | | | |
|---|---|---|---|
| JP | 2008-003396 | A | 1/2008 |
| JP | 2010-089300 | A | 4/2010 |
| JP | 2010-204547 | A | 9/2010 |
| JP | 5848129 | B2 | 1/2016 |

* cited by examiner

*Primary Examiner* — Kristal Feggins
(74) *Attorney, Agent, or Firm* — Manabu Kanesaka

(57) ABSTRACT

The present printing apparatus includes a printing section including a thermal head and a film transfer motor for transferring a transfer film, a memory for storing printing data of different component colors and a control section for controlling the printing section. The control section adjusts the image length at the time of forming an image of each of the component colors on the transfer film by means of the thermal head and printing data of the component color according to the gradation values of the pixels of the pixel group corresponding to a line running in the main scanning direction of the thermal head and the image forming ratio representing the ratio of the number of pixels having the component color relative to the number of the pixels of the pixel group corresponding to the line in the printing data for the component color stored in the memory.

9 Claims, 14 Drawing Sheets

IMAGE FORMING APPARATUS, RECORDING MEDIUM AND IMAGE FORMING SYSTEM

BACKGROUND OF THE INVENTION

Field of the Invention

This invention relates to an image forming apparatus, a recording medium and an image forming system. More particularly, the present invention relates to an image forming apparatus for forming an image on a recording medium by means of a plurality of ink ribbons respectively containing inks of so many different colors, a computer program for causing a computer to operate as part of such an image forming apparatus, a computer-readable recording medium storing such a computer program recorded thereon and an image forming system including an image forming apparatus for forming an image on a recording medium by means of a plurality of ink ribbons respectively containing inks of different colors and a computer communicable with the image forming apparatus.

Related Art

Image forming apparatus for forming images on a transfer medium such as a transfer film, an image carrier or the like and on printing mediums such as cards, sheets of paper, tubes etc. are widely known. Image forming apparatus as described above are either of the indirect printing type of forming an image (mirror image) on a transfer medium typically by means of ink ribbons and then transferring the image formed on the transfer medium onto a printing medium or of the direct printing type of printing an image directly on a printing medium by means of ink ribbons.

Image forming apparatus of the above-identified types generally operate for color printing of generating color images by laying monochromatic images of different colors formed by using inks of different colors one on the other. More specifically, such an image forming apparatus operates for color printing by sequentially printing monochromatic images of different colors one on the other by means of inks of different colors (e.g., Y (yellow), M (magenta) and C (cyan) inks) according to the printing data input thereto or the printing data obtained by converting the image data input thereto into printing data (e.g., Y, M and C printing data) on a medium (a transfer medium when the image forming apparatus is of the indirect printing type or a printing medium when the image forming apparatus is of the direct printing type).

With color printing of generating a color image on a medium, if the images of different color inks formed on the medium are displaced, if slightly, from each other, a blurred color image of degraded printing quality (image quality) is produced on the medium. The phenomenon of displacement of monochromatic images of different color inks is generally referred to as color shift (color registration error). Various techniques have been proposed to date in order to place images of different color inks at a right printing position for the purpose of forming a color image.

The techniques that have been proposed to date include, for example, a technique of printing a color density correction pattern and a color shift correction pattern on an intermediate transfer belt for the purpose of reducing the time required for density and color shift corrections (see Patent Document 1), a technique of executing a registration adjustment operation by utilizing a blank area in the image formable domain of a medium that is not occupied for image printing (see Patent Document 2) and a technique of nipping the thermal head and the platen of an image forming apparatus in a state where the mark formed on a transfer medium is located upstream relative to a sensor and subsequently placing the transfer medium and the ink ribbons at their respective cue positions (see Patent Document 3).

Note that image forming apparatus of both of the above-identified types are more often than not employed to form image forming systems with computers. In the computer of such an image forming system, object generating application software for generating a desired image object (image data) that matches the corresponding printing medium and, if necessary, a printer driver for preparing printing data to be used for the image forming apparatus of the system from the image object are installed in the hard disk drive of the computer and the image object or the printing data generated by the computer are delivered to the printing apparatus (see Patent Document 4).

PRIOR ART DOCUMENT

Patent Document

[Patent Document 1] Japanese Patent Application Publication No. 2008-3396
[Patent Document 2] Japanese Patent Application Publication No. 2010-204547
[Patent Document 3] Japanese Patent Gazette No. 5848129
[Patent Document 4] Japanese Patent Application Publication No. 2010-89300

Meanwhile, in the above-described technical field of image forming apparatus, the time required for an image forming process (image printing operation) has been reduced year by year to meet the needs on the part of the users of image forming apparatus. The reduction of time for image forming processes is supported typically by technical improvements in terms of the amount of heat generated per unit time at the heating elements that the thermal head of the image forming apparatus includes. On the other hand, this improvement is accompanied by a problem that, for example, when a broad image is formed with delicate gradations in the main scanning direction, while heating the heating elements relative to the transfer medium by way of the ink ribbons, the transfer medium is physically elongated by the heat transmitted from the heating elements. Then, a color registration error occurs if monochromatic images are sequentially formed on the transfer medium with inks of different colors without taking the elongation into consideration. In the case of an indirect printing type apparatus, as the images on the transfer medium showing a color registration error are sequentially transferred onto a printing medium, the quality of the image formed on the transfer medium as a result of the image transfers is inevitably degraded. This phenomenon of color registration error is not limited to indirect printing type apparatus and a similar problem occurs to direct printing type apparatus employing mediums (e.g., tubes, films etc.) that are thermally expandable.

SUMMARY OF THE INVENTION

In view of the above-identified problems, it is therefore the object of the present invention to provide an image forming apparatus, a computer program, a recording medium and an image forming system that can produce high quality images on mediums on a sustainable basis, while reducing the time necessary to form images on mediums.

In the first aspect of the present invention, the above object is achieved by providing an image forming apparatus for forming images on mediums by means of ink ribbons respectively containing inks of different component colors, the apparatus including: an image forming unit including a thermal head and a medium conveying section for conveying a medium; a storage unit for storing printing data of different component colors; and a control unit for controlling the image forming unit; the control unit adjusting the image length at the time of forming an image of each of the component colors on the medium by means of the thermal head and printing data of the component color according to the gradation values of the pixels of the pixel group corresponding to a line running in the main scanning direction of the thermal head and the image forming ratio representing the ratio of the number of pixels having the component color relative to the number of the pixels of the pixel group corresponding to the line in the printing data for the component color stored in the storage unit.

In the first aspect of the present invention, it may be so arranged that the control unit adjusts the image length at the time of forming an image of each of the component colors by means of printing data of the component color by modifying the line period of the thermal head and/or the conveyance speed of conveying the medium by means of the medium conveying section. It may alternatively be so arranged that the control unit adjusts the image length at the time of forming an image of each of the component colors by detecting the gradation values and the image forming ratio from the printing data of the component color and adjusting the image length according to the detected gradation values and the detected image forming ratio. It may still alternatively be so arranged that the control unit generates printing data of each of the component colors from the image data input to it and subsequently stores the printing data of the component color generated by the control unit in the storage unit.

Additionally, it may be so arranged that the control unit adjusts the elongation arising to the medium for each line in the sub-scanning direction of the thermal head according to the gradation values and the image forming ratio at the time of forming an image of each of the component colors by means of printing data of the component color. Still additionally, it may be so arranged that the control unit adjusts the image length at the time of forming an image by means of printing data of each of the component colors so as to make it agree with a predetermined value.

In the second aspect of the present invention, the above object is achieved by providing a computer-readable recording medium storing a computer program, the recording medium causing a computer to operate as generation unit for generating printing data for each of the component colors from image data and also as detection unit for detecting the gradation values of the pixels of the pixel group corresponding to a line running in the main scanning direction of the thermal head and the image forming ratio representing the ratio of the number of pixels having the component color relative to the number of the pixels of the pixel group corresponding to the line in the printing data of the component color generated by the generation unit. In the second aspect of the present invention, the recording medium may additionally cause a computer to operate as determination unit for determining the adjustment value for the image length at the time of forming an image using printing data of each of the component colors on a medium by referring to the gradation values and the image forming ratio detected by the detection unit.

In the third aspect of the present invention, the above object is achieved by providing an image forming system including an image forming apparatus for forming an image on a medium by means of ink ribbons containing inks of different colors and a computer capable of communicating with the image forming apparatus, the image forming system including: a generation unit for generating printing data for each of the component colors from image data; a detection unit for detecting the gradation values of the pixels of the pixel group corresponding to a line running in the main scanning direction of the thermal head and the image forming ratio representing the ratio of the number of pixels having the component color relative to the number of the pixels of the pixel group corresponding to the line in the printing data of the component color generated by the generation unit; and a determination unit for determining the adjustment value for the length of the image of each component color according to the printing data of the component color at the time of forming the image on a medium by means of the thermal head by referring to the gradation values and the image forming ratio detected by the detection unit.

Thus, according to the present invention, the image length at the time of forming the image of each of the component colors on a medium by means of the thermal head according to the printing data of the component color is adjusted by referring to the gradation values and the image forming ratio. Therefore, any color registration error can be prevented from taking place regardless of the elongation of the medium produced by the heat applied by the thermal head so that the present invention provides an advantage of producing high quality images on mediums on a sustainable basis by raising the amount of heat generated per unit time by the thermal head, while reducing the time necessary to form an image on a medium.

BRIEF DESCRIPTION OF THE DRAWINGS

FIG. 3A shows the printing section at the standby position. FIG. 3B shows the printing section at the printing position. FIG. 3C shows the printing section at the conveyance position.

FIG. 5A shows an instance where the image forming starting position is specified by means of a mark located at the upstream side in terms of the image forming direction. FIG. 5B shows an instance where the image forming starting position is specified by means of a mark located at the downstream side in terms of the image forming direction.

FIG. 6A illustrates an instance where the printing region of the image transfer film has not been elongated at all. FIG. 6B illustrates an instance where the printing region of the image transfer film has been elongated.

FIG. 13A shows the processing routine of the printer driver the CPU of the control section of the host device executes. FIG. 13B shows the adjustment value determining routine that the CPU of the MCU of the control section of the printing apparatus executes.

FIG. 14A shows the processing routine of the printer driver that the CPU of the control section of the host device executes. FIG. 14B shows the adjustment value determining routine that the CPU of the MCU of the control section of the printing apparatus executes.

DESCRIPTION OF THE EMBODIMENTS

First Embodiment

Now, the first embodiment of the present invention, which is a printing system including a printing apparatus and a computer, will be described below by referring to the related drawings.

1. Configuration 1-1 Printing System 100

Figure 1:
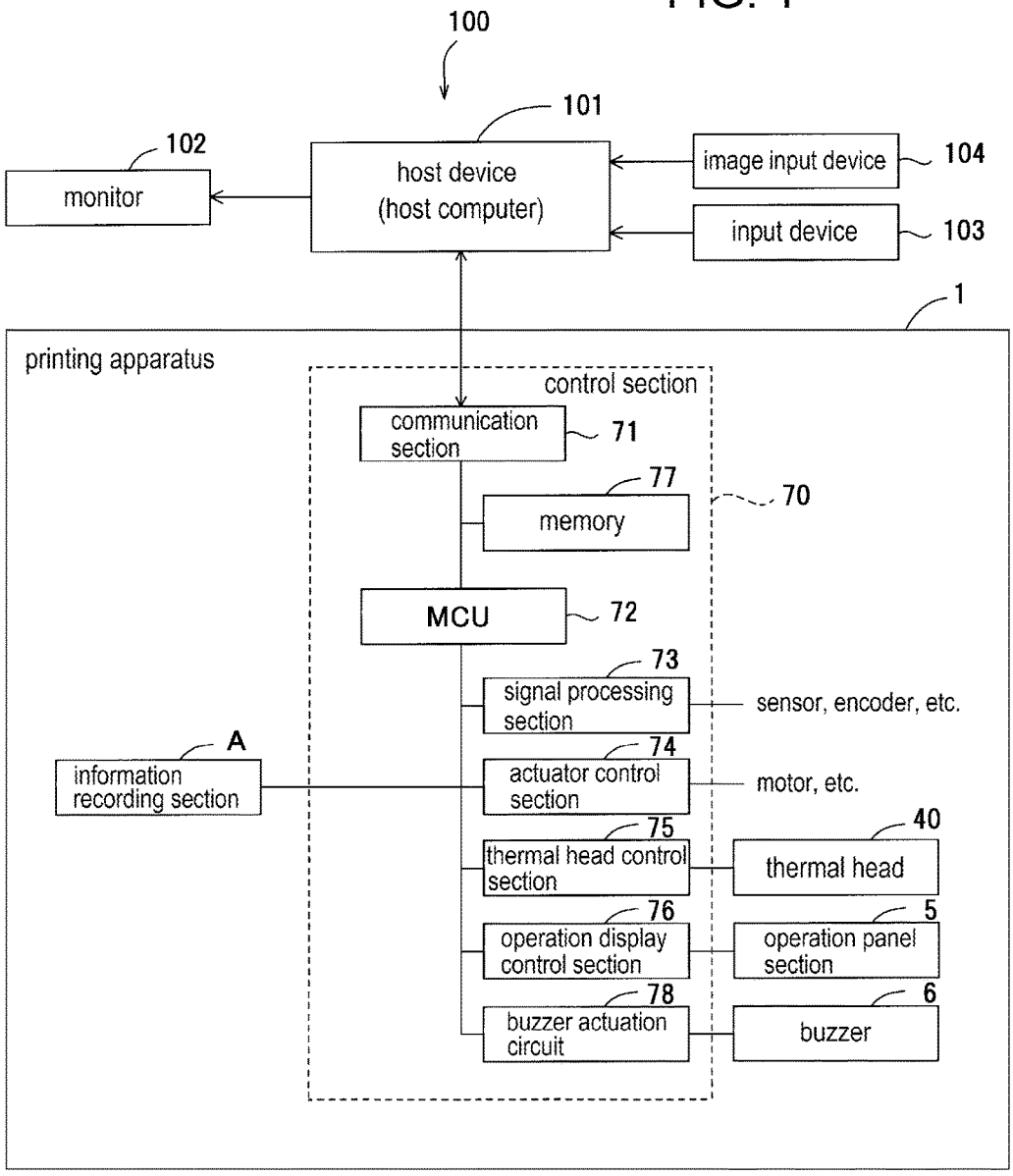
FIG. 1 is a schematic block diagram of the configuration of the control/communication system of the first embodiment of printing system according to the present invention.

As shown in FIG. 1, the printing system 100 of this embodiment includes a printing apparatus 1 that prints and records characters and images on cards and, at the same time, magnetically or electrically records information on the cards and a host device 101 that is communicable with the printing apparatus 1 (e.g., a host computer that may be a personal computer).

The printing apparatus 1 is connected to the host device 101 so that the host device 101 can transmit printing data and magnetic or electric data to the printing apparatus 1 and direct the printing apparatus 1 to execute recording operations. The printing apparatus 1 has an operation panel section (operation display section) 5 so that not only the host device 101 but also the operation panel section 5 can direct the printing apparatus 1 to execute recording operations.

1-2 Host Device 101

The host device 101 has a CPU, a ROM, a RAM and a hard disk drive (to be referred to as HDD hereinafter) as hardware components as well as a communication section 155 that includes a communication interface (see FIG. 7).

The host device 101 is by turn connected to an image input device 104 which may be a digital camera, a scanner or the like, an input device 103 which may include a keyboard and a mouse for inputting instructions and data to the host device 101 and a monitor 102 which may typically be a liquid crystal display for displaying information including the data generated at the host device 101.

1-3 Printing Apparatus 1

1-3-1 Mechanical Section

Figure 2:
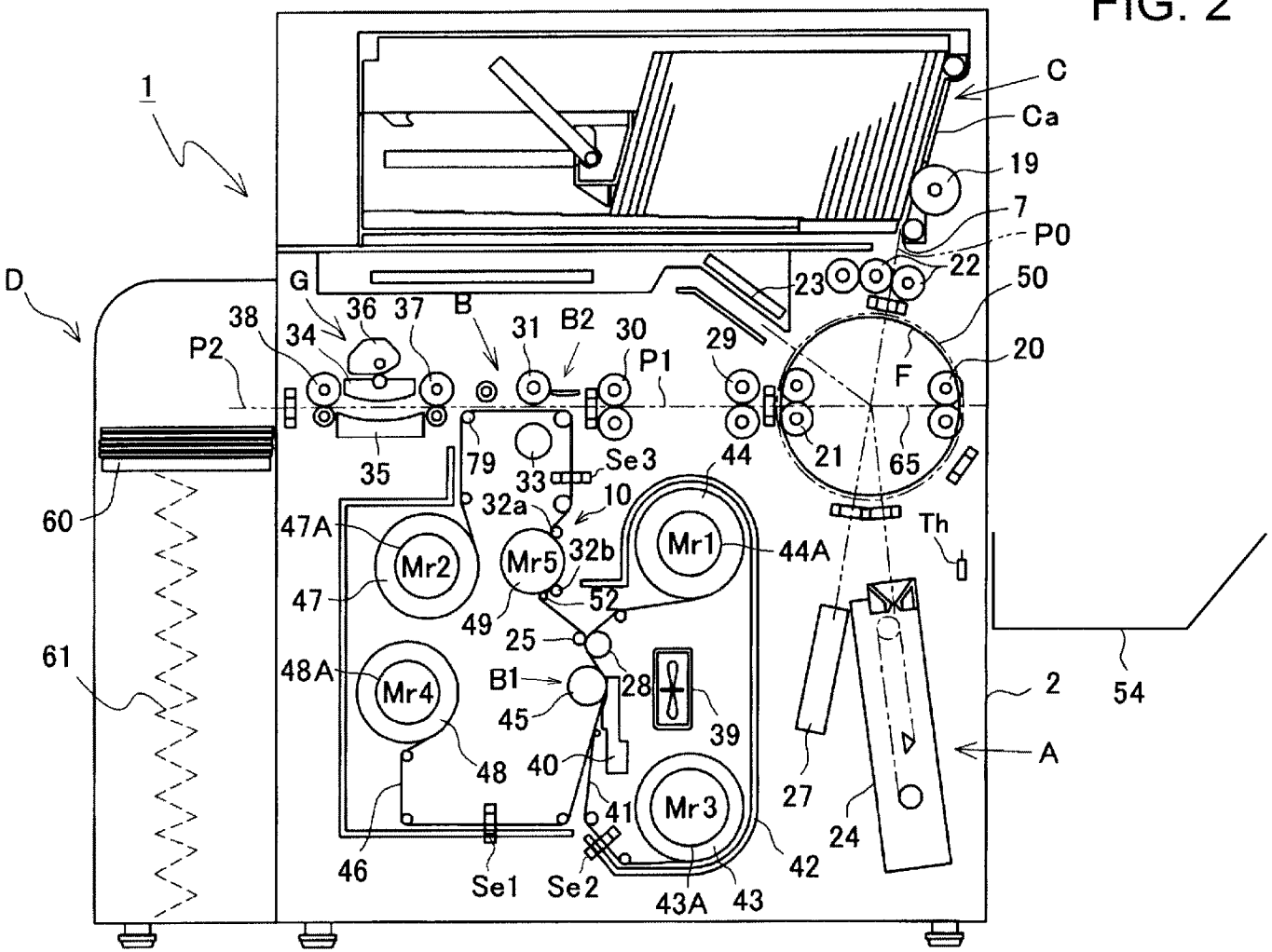
FIG. 2 is a schematic front view of the printing apparatus of the printing system of FIG. 1, showing the overall configuration thereof.

As shown in FIG. 2, the printing apparatus 1 has a housing 2 and an information recording section A, a printing section B, a rotary unit F and a de-curling mechanism G are arranged in the housing 2. The printing apparatus 1 also has a medium supply section C and a medium containing section D, which can be fitted to the housing 2, and a reject stacker 54 fitted to the lateral surface of the housing 2 at a position located oppositely relative to the medium containing section D.

(1) Information Recording Section A

The information recording section A includes a magnetic recording section 24, a non-contact type IC recording section 23, a contact type IC recording section 27. However, the three recording sections are optional and one or more than one of them can be fitted to the printing apparatus 1 according to the request from the user.

(2) Medium Supply Section C

The medium supply section C contains a plurality of cards Ca that are aligned and held to respective (tilted or) upright positions. A separation aperture 7 is formed at the front end of the bottom of the medium supply section C so that a pickup roller 19 can pick up the leading one of the cards C and supply it to the printing section B. In this way the pickup roller 19 can sequentially supply cards. This embodiment is designed to use cards Ca that are 85.6 [mm] wide and 53.9 [mm] long, which conform to dimensional standards. The pickup roller 19 is driven to rotate by a pickup motor (stepping motor) (not shown).

(3) Rotary Unit F

The blank card Ca that is fed out from the medium supply section C is then brought into the rotary unit F by means of a carry-in roller 22 arranged on tilted medium conveyance route P0. The rotary unit F includes a rotary frame 50 that is rotatably supported by the housing 2 and two roller pairs 20 and 21 that are in turn rotatably supported by the rotary frame 50. The carry-in roller 22 and the roller pairs 20 and 21 are driven to rotate by a first card conveyance motor (reversible stepping motor) (not shown) and the rotary unit F is driven to rotate by a rotary motor (reversible stepping motor) (not shown). Note that a gear is arranged at the outer peripheral surface of the rotary frame 50 and engaged with the gear fitted to the motor shaft of rotary motor.

The magnetic recording section 24, the non-contact type IC recording section 23 and the contact type IC recording section 27, which are described above, are arranged along the outer peripheral surface of the rotary unit F. The roller pairs 20 and 21 operate as part of the medium conveyance route 65 for conveying a card Ca toward a selected one of the recording sections 23, 24 and 27. Thus, data are magnetically or electrically written on the card Ca at the selected one of the printing sections. Additionally, a temperature sensor Th, which may typically be a thermistor, for detecting the ambient temperature (external temperature) is arranged near the rotary unit F and the thermal head, the heat roller (which will be described hereinafter) and other related heating elements that are arranged in the printing section B are subjected to temperature adjustment on the basis of the ambient temperature detected by the temperature sensor Th.

(4) Printing Section B

The printing section B includes an image forming section B1 for forming a color image on a transfer film 46 by laying monochromatic images produced by means of ink ribbons of different colors one on the other and a transfer section B2 for transferring the color image formed on the transfer film 46 onto the card, which has been brought in by way of horizontal medium conveyance route P1, by means of the heat roller 33. The printing section B has a film conveyance mechanism 10 for conveying (the image forming region of) the transfer film 46 across the image forming section B1 and the transfer section B2.

Additionally, the horizontal medium conveyance route P1 for conveying a card Ca along a line extending from the medium conveyance route 65 is arranged in the printing section B. Conveyance roller pairs 29 and 30 for conveying a card Ca toward the transfer section B2 are arranged on the horizontal medium conveyance route P1.

(5) De-Curling Mechanism G

A horizontal medium conveyance route P2 for conveying the card Ca, which is now carrying the image transferred onto it, toward a container/stacker 60 is arranged along a line extending from the horizontal medium conveyance route P1 at a position downstream relative to the transfer section B2. Roller pairs 37 and 38 for conveying a card Ca are arranged on the horizontal medium conveyance route P2. Note that all the rollers from the conveyance roller pair 29 down to the conveyance roller pair 38 arranged on the horizontal medium conveyance routes P1 and P2 (including the platen roller 31) are driven to rotate by a second conveyance motor (reversible stepping motor) (not shown).

The conveyance roller pairs 37 and 38 operate as part of the de-curling mechanism G. The de-curling mechanism G corrects the warp that arises to the card Ca as a result the thermal transfer operation by means of the heat roller 33 by pressing a center part of the card Ca that is pinched (nipped) at opposite ends thereof by the conveyance roller pairs 37 and 38 downward by means of its convex de-curling unit 34 against its stationary concave de-curling unit 35 so as to sandwich the card Ca between the two de-curling units 34 and 35. The de-curling unit 34 of the de-curling mechanism G can be moved reciprocally upward and downward by the eccentric cam 36 that the de-curling mechanism G has as shown in FIG. 2.

(6) Medium Container Section D

The medium container section D includes a container/stacker 60 for containing cards Ca that are conveyed and brought in from the de-curling mechanism G, the container/stacker 60 having a card receiving table, and a lifting mechanism 61 for downwardly moving the cards Ca received and laid on the card receiving table depending on the number of cards laid on the table as shown in FIG. 2.

(7) Detail of Printing Section B

Now, the printing section B will be described in greater detail. More specifically, the image forming section B1, the transfer section B2, the operating positions of the printing section B, the image forming starting position and the transfer starting position will sequentially be described in the above-mentioned order.

(7-1) Image Forming Section B1

(a) Principal Members of Image Forming Section B1

The platen roller 45 and the thermal head 40 are two principal members of the image forming section B1. The platen roller 45 and the thermal head 40 are arranged vis-à-vis relative to each other. In an image forming operation, the platen roller 45 is pressed against the thermal head 40 by way of transfer film 46 and ink ribbon 41. Differently stated, as the first eccentric cam (not shown) is driven to rotate, the platen roller 45 can be moved back and forth relative to the thermal head 40.

The thermal head 40 is provided with a plurality of heating elements (1,300 in this embodiment) arranged in row in the main scanning direction. The heating elements are selectively heated under the control of a head control IC (not shown) according to printing data so as to form an image on the transfer film 46 by means of an ink ribbon 41. In image forming operations of this embodiment, the film conveyance mechanism 10 conveys the transfer film 46 at a conveyance speed of 0.8 ms (1/1,000 seconds) per line of the thermal head 40 (to be referred to as the reference conveyance speed hereinafter). In accordance with this conveyance speed, the line period (the time to be spent to forma line of an image by the thermal head 40) is determined to be equal to 0.8 [ms/line] (to be referred to as the reference line period hereinafter). The reference conveyance speed and the reference line period are determined on an assumption that the transfer film 46 is not elongated in an image forming operation of the thermal head 40.

(b) Transfer Film 46

The transfer film 46 shows a belt-like shape having a width slightly greater than the width of the card Ca and has a laminated structure formed by sequentially laying an ink receiving layer for receiving ink from an ink ribbon 41, a protection layer for protecting the front surface of the ink receiving layer, a release layer for promoting the integral release of the ink receiving layer and the protection layer by heating and a base member (base film) in the above-mentioned order.

Figure 5A:
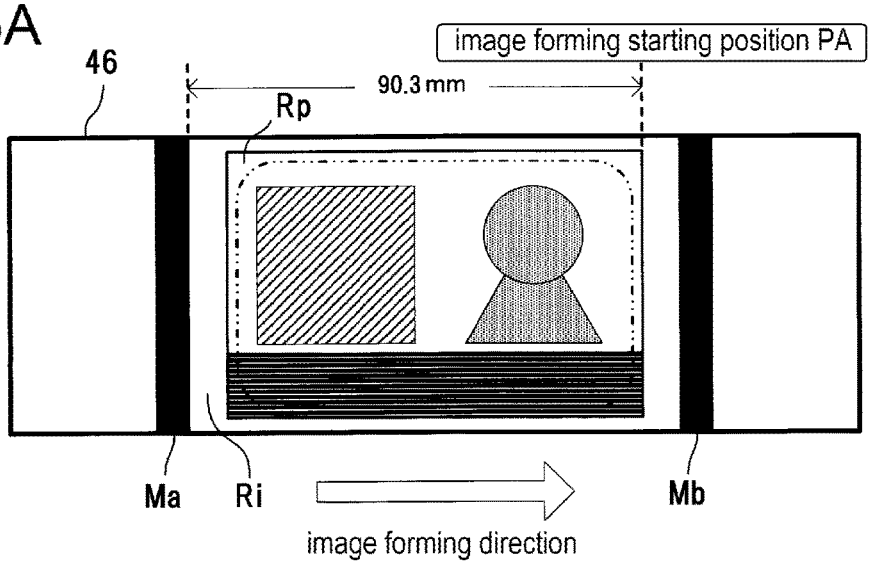
FIGS. 5A and 5B are a schematic illustration of the image forming starting position of an image transfer film.

As shown in FIG. 5A, marks for specifying image forming starting positions are arranged at regular intervals on the transfer film 46 so as to transversally cross the transfer film 46 (i.e. in the main scanning direction of the thermal head 40), namely in a direction perpendicular to the image forming direction (in the sub-scanning direction of the thermal head 40) as indicated by an arrow. An image forming region Ri is provided between any two adjacently located marks. In other words, an image forming region Ri is defined by an upstream side mark Ma and a downstream side mark Mb as viewed in the image forming direction. Note that, in this embodiment, an image forming region Ri is defined to have dimensions of 94 [mm] (as viewed in the transversal direction in FIG. 5A) and 60 [mm] (in the longitudinal direction in FIG. 5A) and each of the marks Ma and Mb has a width of 4 [mm] (as viewed in the longitudinal direction in FIG. 5A).

Note that, in the image forming region Ri shown in FIG. 5A, the rectangular region enclosed by a solid line is the printing region Rp of the thermal head 40 and the region enclosed by a two-dot chain line corresponds to the size of the card Ca. In this embodiment, the printing region Rp of the thermal head 40 is defined to have dimensions of 86.6 mm (in the transversal direction in FIG. 5A) and 54.9 mm (in the longitudinal direction in FIG. 5A). Thus, the printing region Rp has a margin of 0.5 [mm] relative to a card Ca of the standard size both in the longitudinal direction and in the transversal direction (and hence is larger than a card Ca of the standard size). Thus, both the distance from the front end of the mark Ma to the printing region Rp of the thermal head 40 (image forming ending position) and the distance from the rear end of the mark Mb to the image forming starting position PA are equal to 3.7 mm.

As shown in FIG. 2, the transfer film 46 is fed out and taken up respectively by feed roll 47 and take-up roll 48 arranged in the transfer film cassette as the rolls are driven to rotate respective by means of Motors Mr2 and Mr4. More specifically, a feed spool 47A and take-up spool 48A are arranged respectively at the center of the feed roll 47 and at the center of the take-up roll 48 in the transfer film cassette and the rotary driving force of the motor Mr2 and the rotary driving force of the motor Mr4 are transmitted respectively to the feed spool 47A and the take-up spool 48A by way of respective gears (not shown). Both of the motors Mr2 and Mr4 are reversible DC motors. Encoders (not shown) are fitted respectively to the motor shafts of the motors Mr2 and Mr4 at positions opposite to the sides of the output shafts thereof so as to detect the rpm (revolutions per minute) of the motor Mr2 and that of the motor Mr4.

Note that, in this embodiment, before an image transfer operation, the unused part of the transfer film 46 is wound around the feed spool 47A, whereas the used part, if any, (that has been subjected to an image transfer process at the transfer section B2) of the transfer film 46 is wound around the take-up spool 48A. Thus, in an operation in which an image forming process (also referred to as primary transfer process) and a transfer process (also referred to as secondary transfer process) are executed on the transfer film 46, the transfer film 46 is fed out once from the feed spool 47A toward the take-up spool 48A and the image forming process and the transfer process are executed while the transfer film 46 is being taken up by the feed spool 47A.

(c) Film Conveyance Mechanism 10

Film conveyance roller 49 is a major drive roller for conveying the transfer film 46. The distance by which the transfer film 46 is conveyed at a time and the conveyance suspending position of the transfer film 46 are determined by controlling the drive operation of the film conveyance roller 49. The film conveyance roller 49 is linked to reversible film conveyance motor Mr5 (stepping motor). The motors Mr2 and Mr4 are also put into operation when the film conveyance roller 49 is driven to operate and their operations are such that the transfer film 46 fed out from the feed roll 47 is taken up by the take-up roll 48 or vice versa so as to apply tension to the transfer film 46 that is being conveyed. In other words, their operations are auxiliary relative to the film conveying operation. An encoder (not shown) is fitted to the roller shaft of the film conveyance roller 49.

Pinch roller 32*a* and pinch roller 32*b* are arranged at the peripheral surface of the film conveyance roller 49. The film conveyance roller 49 is provided with a tension receiving member 52 in order to prevent any possible separation of the transfer film 46 from the film conveyance roller 49 from taking place due to the tension that arises at the transfer film 46 when the pinch rollers 32*a* and 32*b* press the transfer film 46 against the film conveyance roller 49.

The pinch rollers 32*a* and 32*b* can be moved back and forth relative to the film conveyance roller 49 as the second eccentric cam (not shown) is drive to rotate. The tension receiving member 52 can also be moved back and forth relative to the transfer film 46 as the second eccentric cam is driven to rotate. Note that the roller shafts of the pinch rollers 32*a* and 32*b* and the tension receiving member 52 are supported at the opposite ends thereof by a support member (not shown) having a small roller that is securely held by the support member so as to contact the second eccentric cam. FIG. 2 shows a state where the pinch rollers 32*a* and 32*b* are forced to move forward toward the film conveyance roller 49 and the transfer film 46 is wound around the film conveyance roller 49 while the tension receiving member 52 is held in contact with the transfer film 46. Then, with this arrangement, the transfer film 46 is conveyed accurately by a distance that corresponds to the number of revolutions of the film conveyance roller 49.

With the film conveyance mechanism 10, therefore, as the film conveyance roller 49 that is arranged between the image forming section B1 and the transfer section B2 is driven to rotate, the transfer film 46 is conveyed either forwardly or backwardly among the feed roll 47, the image forming section B1, the transfer section B2 and the take-up roll 48, while the image forming region Ri of the transfer film 46 is made to be located at its proper position in the image forming section B1 and also at its proper position in the transfer section B2.

A sensor Se1 having a light emitting element and a light receiving element is arranged between the take-up roll 48 and the image forming section B1 (the thermal head 40 and the platen roller 45) to detect a mark formed on the transfer film 46 as described earlier. Additionally, a cooling fan 39 is arranged near the thermal head 40 in order to cool the thermal head 40.

(d) Ink Ribbon 41

The ink ribbon 41 is contained in an ink ribbon cassette 42 in a state where it is stretched between the feed roll 43 for feeding the ink ribbon 41 to the ink cassette 42 and the take-up roll 44 for taking up the ink ribbon 41. A take-up spool 44A and a feed spool 43A are arranged respectively at the center of the take-up roll 44 and at the center of the feed roll 43, of which the take-up spool 44A is driven to rotate by the driving force of the motor Mr1 and the feed spool 43A is driven to rotate by the driving force of the motor Mr3. Reversible DC motors are employed for the motor Mr1 and the motor Mr3. Encoders (not shown) are fitted respectively to the motor shaft of the motor Mr1 and that of the motor Mr3 at positions opposite to the sides of the output shafts thereof so as to detect the rpm (revolutions per minute) of the motor Mr1 and that of the motor Mr3.

The ink ribbons 41 of the printing apparatus of the embodiment are so arranged that the color ink panels of yellow (Y), magenta (M) and cyan (C) and the black (Bk) ink panel are panel-sequentially fed out in the longitudinal direction. Note that in this embodiment, sublimation inks are employed for the color ink panels of Y, M and C, while thermofusible ink is employed for the Bk ink panel.

A sensor Se2 is arranged between the feed roll 43 and the image forming section B1 (including the thermal head 40 and the platen roller 45). The sensor Se2 operates to detect the position of the ink ribbon as the beam of light emitted from the light emitting element is intercepted by the Bk ink panel at the side of the light receiving element and then put the ink ribbon 41 in its initial position for moving toward the image forming section B1.

(e) Relationship with Transfer Section B2

The ink ribbon 41 whose operation of forming an image on the transfer film 46 has ended is then moved away from the transfer film 46 by means of peeling roller 25 and peeling member 28. The peeling member 28 is rigidly secured to the ink ribbon cassette 42 and the peeling roller 25 is held in contact with the peeling member 28 during the image forming process so that the ink ribbon 41 is peeled off from the transfer film 46 as the transfer film 46 and the ink ribbon 41 are pinched between the peeling roller 25 and the peeling member 28. Then, the ink ribbon 41 that has been peeled off from the transfer film 46 is taken up onto the take-up roll 44 by the driving force of the motor Mr1, while the transfer film 46 is conveyed to the transfer section B2 by the conveyance mechanism 10. Note that the roller shaft of the platen roller 45 and the peeling roll 25 are supported at the opposite ends thereof by a support member (not shown) having a small roll that is securely held to the support member and held in contact with the above-described first eccentric cam so that, as the first eccentric cam is driven to rotate, the platen roller 45 that has been pressed against and held in contact with the thermal head 40 is released from the thermal head 40 and, at the same time, the peeling roller 25 that has also been pressed against and held in contact with the peeling member 28 is also released from the peeling member 28.

Sensor Se3 for detecting a mark formed on the transfer film 46 is arranged at a position downstream relative to the film conveyance roller 49. As the sensor Se3 detects a mark, the card Ca that is pinched by the conveyance roller pairs 29 and 30 and held stationary (on a standby status) on the horizontal medium conveyance route P1 starts to be conveyed toward the transfer section B2 by a conveyance operation so that both the image forming region Ri (printing region Rp) of the transfer film 46 and the card Ca simultaneously arrive at the transfer section B2. Note that the sensor Se3 is a transmission/integral type sensor.

(7-2) Transfer Section B2

In the transfer section B2, the transfer film 46 is pinched by the heat roller 33 and the platen roller 31 along with the card Ca. Then, the image formed in the image forming region Ri of the transfer film 46 is transferred onto the card Ca. More specifically, in the image transfer operation, the heat roller 33 is pressed against the platen roller 31 by way of the card Ca and (the image forming region Ri of) the transfer film 46, while both the card Ca and the transfer film 46 are conveyed together at the same rate in the same direction. Note that the heat roller 33 is fitted to a lifting mechanism (not shown) such that it can be pressed against and moved away from the platen roller 31 with the transfer film 46 interposed between them.

After the image transfer operation, the transfer film 46 is separated (peeled off) from the card Ca by peeling pin 79 arranged between the heat roller 33 and the follower roller (the lower side roller in FIG. 2) of the conveyance roller pair 37 and conveyed toward the feed roll 47. On the other hand, the card Ca carrying the image transferred onto it is conveyed on the horizontal medium conveyance route P2 toward the de-curling mechanism G arranged downstream relative to the transfer section B2 (see also FIG. 4).

(7-3) Operating Positions of Printing Section B

The printing section B is made to take one of the three operating positions thereof including a standby position, a printing position and a conveyance position by controlling the rotary motion of the first eccentric cam and that of the second eccentric cam.

(a) Standby Position

Figure 3A:
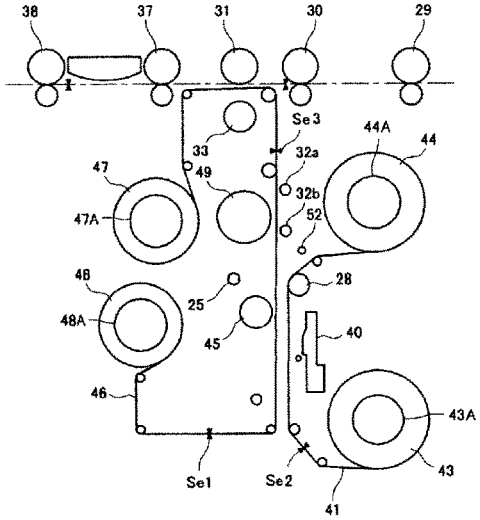
FIGS. 3A through 3C are a schematic illustration of the operating positions of the printing section of the printing apparatus of FIG. 2.

FIG. 3A shows the printing section B in the standby position. In this position, the pinch rollers 32*a* and 32*b* are not pressed against the film conveyance roller 49 nor the tension receiving member 52 held in contact with the film conveyance roller 49. Furthermore, the platen roller 45 is not pressed against the thermal head 40 nor the peeling roller 25 held in contact with the peeling member 28.

(b) Printing Position

Figure 3B:
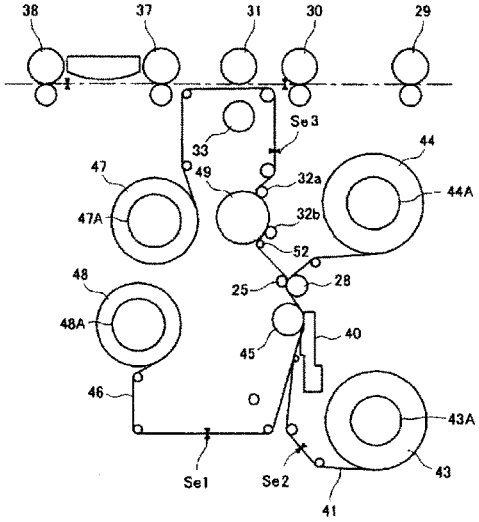

FIG. 3B shows the printing section B moved to the printing position. At this time, firstly the pinch rollers 32*a* and 32*b* wind the transfer film 46 around the film conveyance roller 49 and, at the same time, the tension receiving member 52 is brought into contact with the transfer film 46. Subsequently, the platen roller 45 is pressed against and brought into contact with the thermal head 40. In this printing position, the platen roller 45 is moved toward the thermal head 40 to pinch the transfer film 46 and the ink ribbon 41 between the platen roller 45 and the thermal head 40.

In this state, the transfer film 46 is conveyed by the rotary motion of the film conveyance roller 49 and, at the same time, the ink ribbon 41 is taken up by the take-up roll 44 so as to be conveyed in the same direction as the motor Mr1 is driven to operate. During the conveyance operation, as the mark formed on the transfer film 46 passes by the sensor Se1 and the transfer film 46 gets to the image forming starting position (which will be described in greater detail hereinafter), the thermal head 40 starts forming an image in the image forming region Ri of the transfer film 46.

The amount of conveyance of the transfer film 46 (the distance by which the transfer film 46 is conveyed in the conveyance direction) is detected by the encoder arranged on the film conveyance roller 49 and, as the transfer film 46 is conveyed by a predetermined distance, the rotary motion of the film conveyance roller 49 is stopped and, at the same time, the operation of taking up the transfer film 46 onto the take-up roll 44 by the driving force of the motor Mr1 is also stopped. Then, as a result, the image forming operation of forming an image in the image forming region Ri of the transfer film 46 by means of the ink on the first ink panel (e.g., Y ink panel) is terminated.

(c) Conveyance Position

Figure 3C:
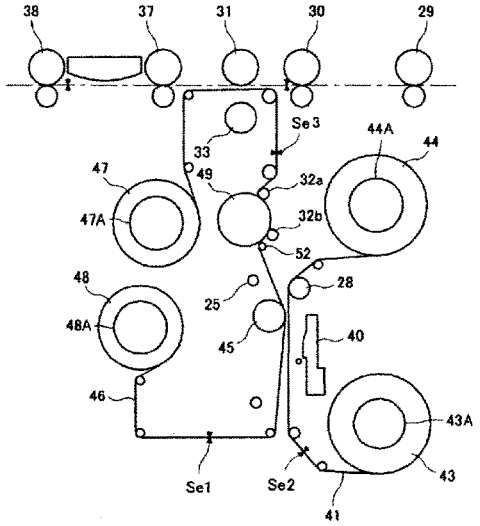

As the image forming operation using the ink of the first ink panel is terminated, the printing section B is shifted to the conveyance position and the platen roller 45 is moved away from the thermal head 40 (while the peeling roller 25 is released from the peeling member 28 with which the former has been held in contact). FIG. 3C shows the state where the printing section B has been shifted to the conveyance position. In this state, the transfer film 46 is still wound around the film conveyance roller 49 by the pinch rollers 32*a* and 32*b* and the tension receiving member 52 is held in contact with the transfer film 46.

In the above-described state, the transfer film 46 is conveyed back to the initial position (cue position) by the rotary motion of the film conveyance roller 49 in the reverse direction. Again, the distance by which the transfer film 46 is moved is controlled by means of the rotary motion of the film conveyance roller 49. Note, however, that the transfer film 46 is moved back to the initial position (cue position) by a predetermined length that is greater than the length by which the image forming region Ri, which now carries the first image formed by the first color ink panel (e.g. Y ink panel), has been conveyed in the proper conveyance direction so that the mark goes beyond the detecting position of the sensor Se1. Also note that the ink ribbon 41 is also wound back by a predetermined length by means of the motor Mr3 and the ink panel of the ink for forming the second image is brought to a standby status at its initial position (cue position).

(d) Position Shift for Printing Operation

In a color printing operation, after the transfer film 46 and the ink ribbon 41 are conveyed back to the respective initial positions from the conveyance position, they are moved to the printing position shown in FIG. 3B and the platen roller 45 is pressed against the thermal head 40 and held in contact with the latter. Then, the film conveyance roller 49 conveys the image forming region Ri of the transfer film 46 to the printing position, where the next image forming process is executed by the thermal head 40, using the ink of the second ink panel (e.g., M ink panel).

The operations at the printing position and at the conveyance position as described above are repeated until the image forming process by means of ink of all or the selected one or ones of the ink panels is completed. As the image forming process by the thermal head 40 ends, the platen roller 45 that has been pressed against and held in contact with the thermal head 40 is released. Thereafter, the film conveyance motor Mr5 is driven (along with the motors Mr2 and Mr4) to convey the image forming region Ri of the transfer film 46 toward the transfer section B2.

(7-4) Image Forming Starting Position and Transfer Starting Position (a) Image Forming Starting Position The process of forming an image in the image forming region Ri by means of the thermal head 40 is started as the film conveyance motor Mr5 is driven to operate, the sensor Se1 is caused to detect the front end of mark Ma and subsequently the mark Ma is conveyed toward the side of the image forming section B1 by a predetermined distance (e.g., several millimeters). This position is the image forming starting position PA (the position separated from the front end of the mark Ma by 90.3 mm) as shown in FIG. 5A. Additionally, as the motor Mr1 is driven to operate simultaneously, both the transfer film 46 and the ink ribbon 41 are conveyed in the same direction at the same moving speed at the image forming section B1.

Note that, prior to (the start of) the image forming process, the heating elements belonging to the thermal head 40 are preliminarily heated (to a predetermined temperature lower than the temperature at which the ink of the ink ribbon 41 is transferred onto the image forming region Ri of the transfer film 46).

(b) Transfer Starting Position

Figure 4:
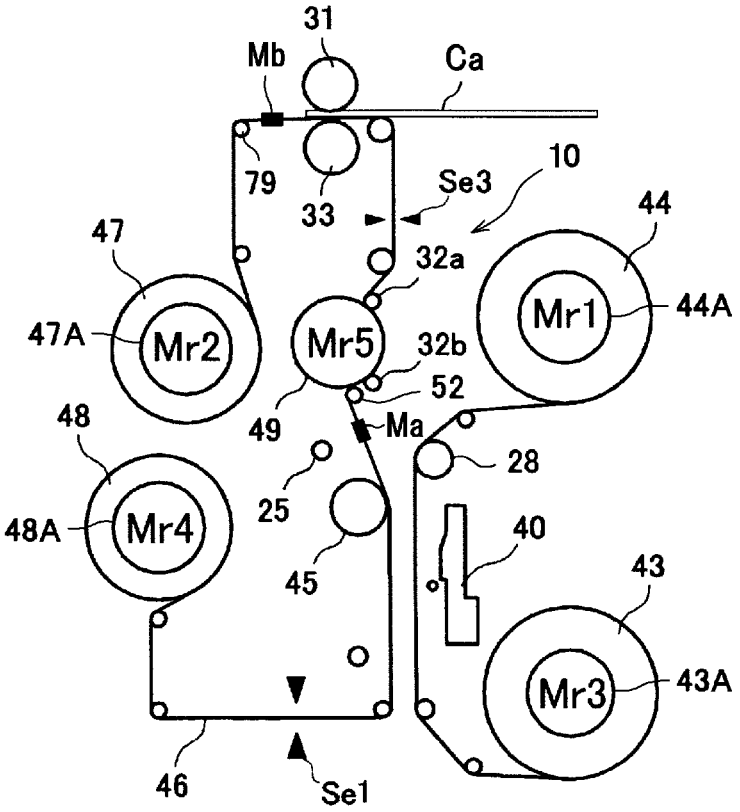
FIG. 4 is a schematic front view of the printing apparatus in an image transfer operation.

FIG. 4 is a schematic front view of the printing apparatus 1 in an image transfer operation that is executed at the transfer section B2. For the transfer process, the sensor Se3 detects the mark Mb and places it in the initial position. In this embodiment, after the film transfer motor Mr5 is driven to operate and the front end of the mark Mb is detected by the sensor Se3, the transfer film 46 is conveyed further by 30 mm and the position that the transfer film 46 reaches after being conveyed by 30 mm is defined as the transfer starting position.

Figure 6A:
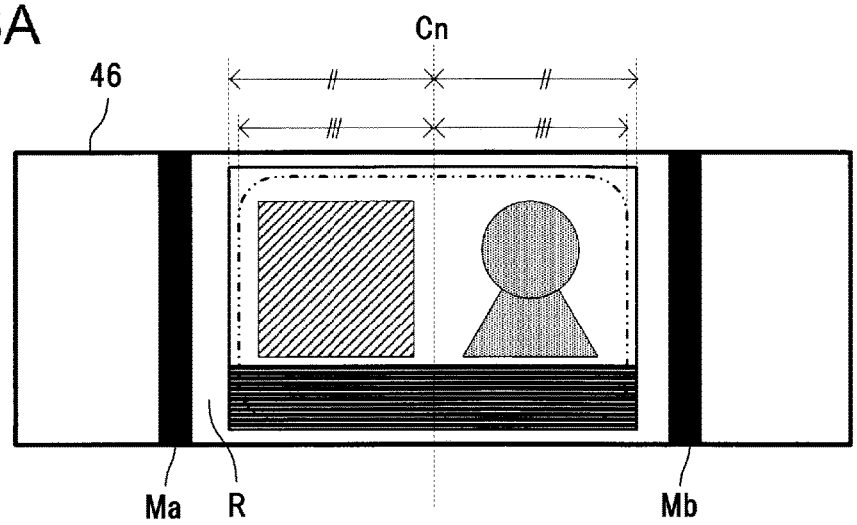
FIGS. 6A and 6B are a schematic illustration of the image transfer positions of a transfer film at the time of an image transfer operation.

FIG. 6A schematically illustrates the operation of aligning the image forming region Ri and the card Ca when the image forming region Ri of the transfer film 46 does not show any elongation. As shown in FIG. 6A, in the transfer section B2, the transfer film 46 is placed at its initial position such that the center Cn of the length of the printing region Rp of the thermal head 40 in the image forming direction agrees with the center of the card Ca in the longitudinal direction thereof. Under this condition (in a state where the image forming region Ri is not elongated at all), the center Cn of the length of the printing region Rp in the image forming direction agrees with the center of the card Ca in the longitudinal direction thereof as the sensor Se3 detects the front end of the mark Mb and subsequently the transfer film 46 is conveyed further by 30 mm as described above.

1-3-2 Control Section

As shown in FIG. 1, the printing apparatus 1 includes a control section 70 for controlling the entire operation of the printing apparatus 1. The control section 70 includes a microcomputer unit 72 (to be referred to as MCU 72 hereinafter) that controls the printing apparatus 1. The MCU 72 in turn includes a CPU or central processing unit that operates with a high speed clock, a ROM storing the programs and the program data of the printing apparatus 1, a RAM that provides a work area for the CPU and an internal bus for connecting the above-listed components of the MCU 72.

The MCU 72 is connected to an external bus. The external bus is in turn connected to a communication section 71 having a communication IC that communicates with the host device 101 and a memory 77 for temporarily storing the printing data of the image to be formed on the card Ca, the recording data to be magnetically or electrically recorded on the magnetic stripe of the card Ca and a housing IC and so on.

The external bus is also connected to a signal processing section 73 for processing the signals coming from the above-described sensors and encoders, an actuator control section 74 that includes a motor driver for supplying drive pulses and electric driving power to the motors, a thermal head control section 75 having the above-described head control IC and operating to control the thermal energy of the heating elements belonging to the thermal head 40, an operation display control section 76 for controlling the operation panel section 5, the above-described information recording section A and a buzzer actuation circuit 78 for actuating a buzzer 6 when a conveyance error such as double card feeding of cards Ca or a recording failure of the information recording section A takes place.

2. Technical Background of Printing System 100

Now, the technical background of the printing system 100 of this embodiment will be briefly described below.

As described above prior to describing the summary of the invention, (when the printing data given to the printing system 1 involve the use of many pixels for delicate gradations) the image forming region Ri of the transfer film 46 is elongated in the sub-scanning direction of the thermal head 40 as a result of forming an image in the printing region Rp by means of the heating elements of the thermal head 40.

With the printing system 100 of this embodiment, the image length in the printing region Rp is adjusted when forming an image in the image forming region Ri by means of the thermal head 40 according to the printing data for one of the component colors on an assumption that an elongation arises to the transfer film 46 as a result of the use of the heating elements of the thermal head 40. In other words, any possible color shift is prevented from taking place by adjusting the image length in the printing region Rp in the image forming direction thereof so as to make it show a constant length (86.6 mm in this embodiment as described above by referring to FIG. 5A).

The inventors of the present invention conducted a large number of image forming experiments by means of actual printing apparatus to look into what elements in printing data are related to elongations of transfer films 46. As a result of the experiments, the inventors found that the gradation values of the pixels of the pixel group in the printing data corresponding to a line running in the main scanning direction of the thermal head 40 and the image forming ratio representing the ratio of the number of pixels having the component color (in the printing data) relative to the number of the pixels of the pixel group corresponding to a line running in the main scanning direction of the thermal head 40 are the major causes of the elongation of the transfer film 46.

On the basis of this finding, the image length of the printing region Rp is adjusted according to the gradation values and the image forming ratio for each line so as to make it show a constant value when an image is formed by the thermal head 40 in the printing apparatus 1. In other words, the line period is reduced relative to the reference line period of the thermal head 40 in view of the elongation that arises to the printing region Rp for the purpose of making the image length show a constant value. Note that the line period can be modified for each line but the conveyance speed of the transfer film 46 is maintained to a constant value when forming an image in the image forming region Ri.

3. Operation

Now, the operation of the printing system 100 of this embodiment will be described below.

3-1 Summary of Operation

In the printing system 100 of this embodiment, the host device 101 produces printing data for each of the component colors by converting the corresponding image data and detects the gradation values and the image forming ratio of each line in the printing data for each of the component colors. Then, it determines the adjustment value for the line period of each line of the thermal head 40 to be used when forming an image in the image forming region Ri (printing region Rp) of the transfer film 46 by means of the printing apparatus 1 according to the gradation values and the image forming ratio for each line. Then, the host device 101 transmits the printing data and the line period adjustment value for each of the component colors to the printing apparatus 1. On the other hand, the printing apparatus 1 forms an image in the image forming region Ri by means of the thermal head 40 according to the printing data and the adjustment value it receives. These operations will be described in greater detail below.

3-2 Operation of Host Device 101

Figure 7:
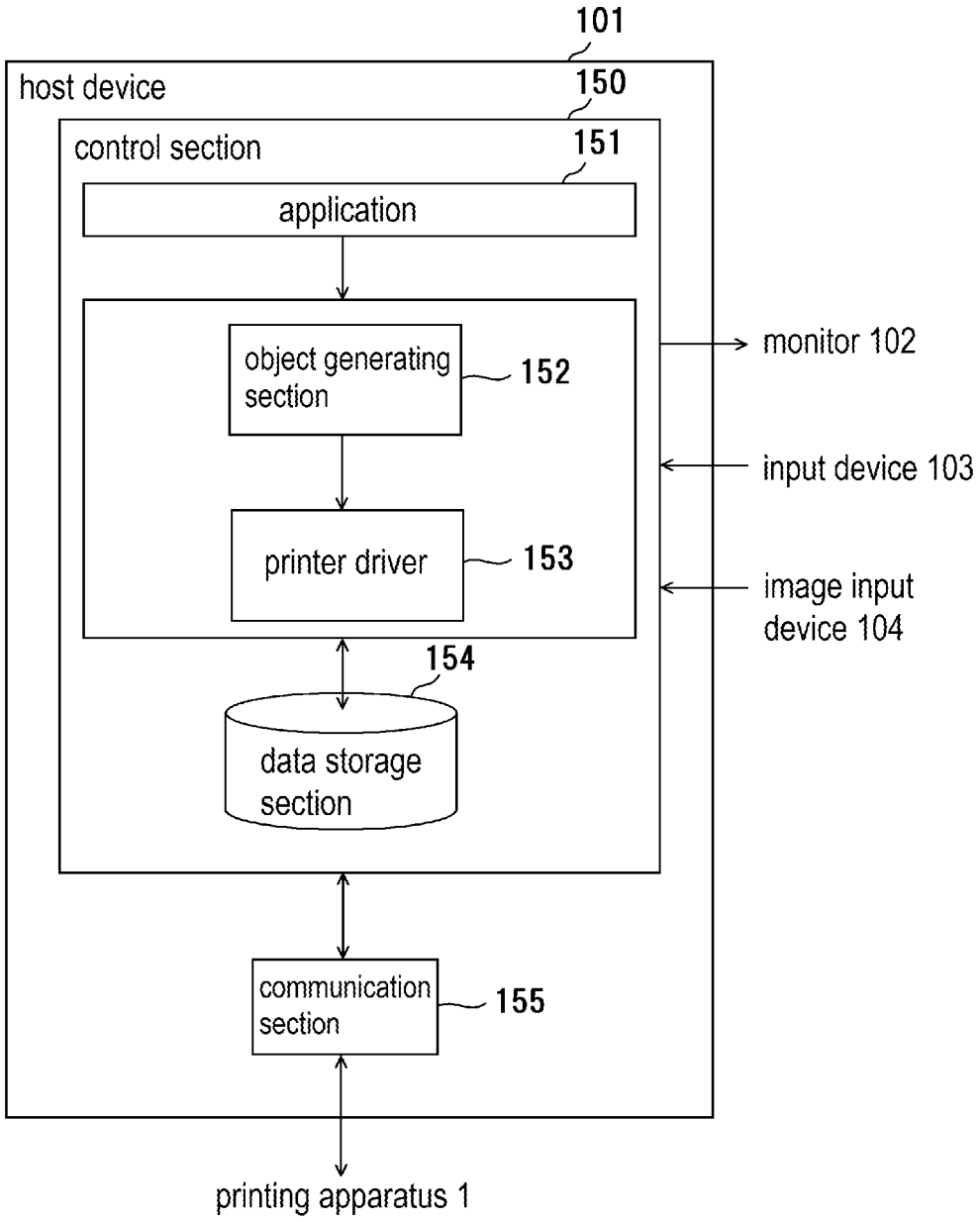
FIG. 7 is a function block diagram of the control section of the host device of the printing system of FIG. 2, showing the flow of operation of the control section.

As shown in FIG. 7, the CPU, the ROM, the RAM and the HDD of the host device 101 operate as control section 150. In other words, the CPU takes a major role in the control section 150 and operates according to the programs (and the program data) stored in the ROM and developed in the RAM.

Object generating application software for generating desired image data (image objects) for the image to be printed on a card Ca, a printer driver (application software) for generating printing data to be used by the printing apparatus from the image data generated by the object generating application software and other software are installed in the HDD of the control section 150.

The programs of the application software may be installed in the HDD by way of one or more recording mediums which may be CD-ROMs, floppy disks (FDs), USB memories, ZIPs and/or MOs that the host device 101 can read or, alternatively, when the host device 101 is a member of a communication network, the host device 101 may acquire the programs from some other computer or computers by way of the communication section 155 and install them in the HDD.

The CPU of the control section 150 realizes the functional features of the object generating section 152 and the printer driver 153 by developing the object generating application software and the printer driver installed in the HDD simultaneously or selectively on the RAM as application 151. Note that the HDD also operates as data storage section 154 for storing the data that are being generated (processed) or the data that have been generated (processed) by the object generating section 152 and the printer driver 153.

3-2-1 Object Generating Section 152

The object generating section 152 includes an individual object generating section, an object integration section for integrating a plurality of objects, an image data generating section for generating image data from an integrated object and GDI (graphic device interface, see JP 2004-194041A) that outputs image data and other data to the printer driver 153. The above-mentioned sections except the GDI have the functional feature of a GUI (graphic user interface) for controlling the inputs to and the outputs from the monitor 102, the input device 103 and the image input device 104 by utilizing the functions provided by the OS (operating system).

(1) Individual Object Generating Section

Figure 9:
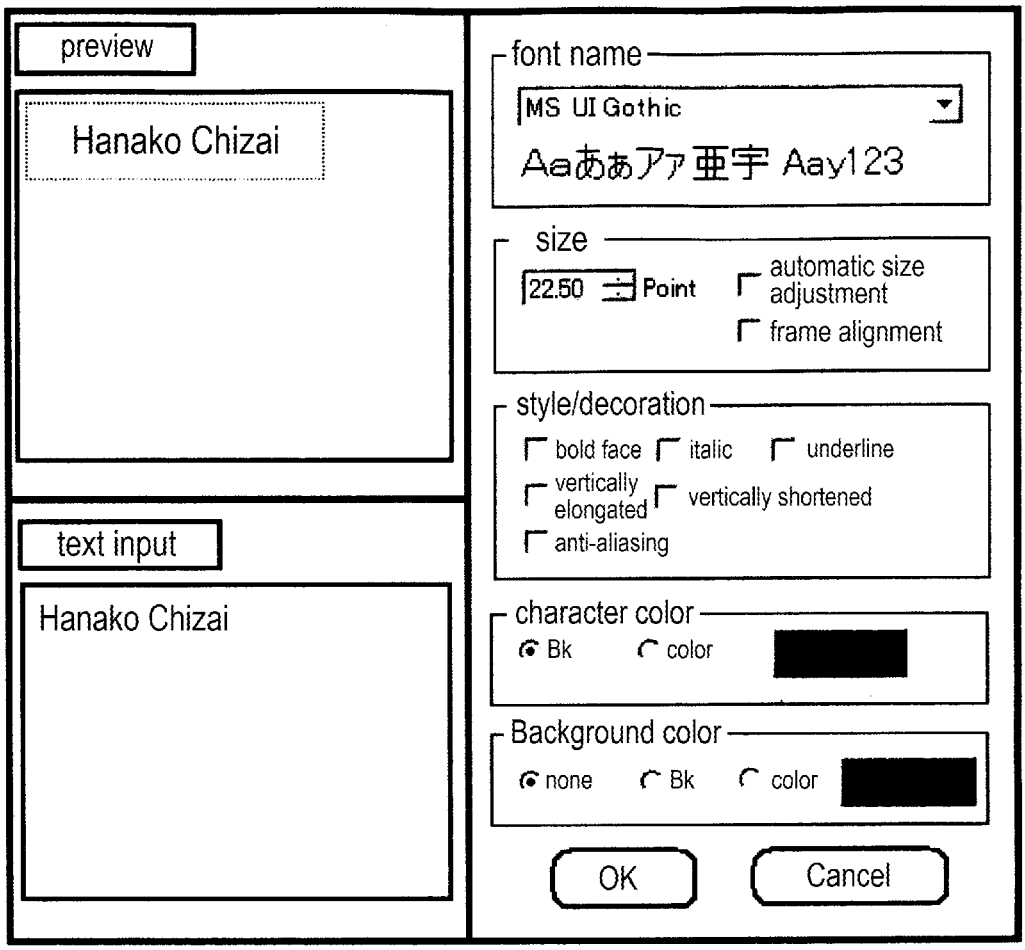
FIG. 9 is a schematic illustration of an exemplar image displayed on the monitor of the host device by the object generating section.

FIG. 9 schematically illustrates an exemplar image displayed on the monitor 102 when a printing object of the name (Hanako Chizai) of the card proprietor that is to be printed on the card Ca is generated. In this example, the operator inputs "Hanako Chizai" (text data) in the blank box under the heading of "Input Text" by means of the keyboard of the input device 103 and also inputs printing information including the font name, the font size, the style/decoration, the character color and the background color by means of the mouse (not shown) of the input device 103. The printing object generated from the input text data and the printing information input by the operator is displayed in the box under the heading of "Preview".

The operator prepares the desired printing object (text data) by operating the input device 103 (for modification) by referring to the preview and then clicks the OK button. Then, as a result, the individual object generating section takes in a single printing object (including the size information on the object) and adds the name and the number for identifying the printing object. Then, the operator contains the printing object in a predetermined folder. While the printing object displayed in the "Preview" box is formed by a plurality of characters and the same font and the same font size are used for the plurality of characters in this example, alternatively, the printing object may be formed by a single character or by a plurality of characters whose respective fonts and font sizes are different from each other.

A card Ca on which the printing process has been completed generally contains various printing objects (text data) including the name of the company or some other organizational entity to which the proprietor of the card belongs, the card proprietor's ID number and other pieces of information in addition to the proprietor's name. In other words, the individual object generating section can generate printing objects (other than the proprietor's name) such as the above-described ones and the above-described folder can be made to contain the generated plurality of printing objects. Since the name of the company or some other organizational entity to which the proprietor of the card belongs are common to a number of proprietors of other cards, the printing object thereof that is contained in some other folder may be copied and the card proprietor's folder may be made to contain the copy of the printing object.

In many instances, a completed card Ca generally contains an image object of a proprietor's face photo, that of the logo of the company to which the proprietor belongs, that of the background image of the card and so on, which are printed on the card. Then, the above-described folder may be made to contain these image objects or some other folder may be used to contain these image objects. These image objects may be taken in from the image input device 104 or the desired image objects stored in some other computer may be retrieved by way of the communication section 155 for use.

(2) Object Integration Section

The operator prepares a desired image object to be printed on the card Ca by using a plurality of objects contained in the above-described folder. The object integration section displays the preview images of all the objects on the monitor 102 and assists the operator for the operation of arranging a plurality of objects. Then, as a result, the operator can obtain an integrated object in which the proprietor's name, the company name, the ID number, the face photo, the logo and so on are arranged at respective desired positions.

The object integration section judges if the OK button for the preview image is clicked or not. If it is judged that the OK button is clicked, it assumes that the arrangement for the (integrated) image object to be printed on the card Ca has been finalized and acquires the positional information of each of the objects that were used to produce the integrated object. In other words, the object integration section has a functional feature of adding the positional information to each of the individual objects. Note that the positional information of each of the individual objects is stored in the above-described folder in this embodiment but it may alternatively be stored in some other folder.

(3) Image Data Generating Section

The image data generating section converts each of the printing objects of the text data into image data such as bitmap data and generates image data for each of the surfaces of the card Ca by integrating all the image data.

Additionally, the image data generating section causes the operator to determine if the generated image data are to be used for single-sided printing or double-sided printing and also determine if they are to be used for the front surface or the rear surface of the card Ca. Then, the image data generating section acquires the results of the determinations as attribute information for the image data. Still additionally, the image data generating section requests the operator to input the data to be recorded on the magnetic stripe of the card Ca and the data to be recorded on the IC and select and specify the recording section (23, 24, 27) to be used. Then, the image data generating section acquires the results of the input as recording data.

Thereafter, the image data generating section outputs the image data, the attribute information and the recording data as described above to the GDI by utilizing the API (application program interface) function.

(4) GDI

The GDI delivers the image data, the attribute information and the recording data contained in a single folder to the printer driver 153 by utilizing the DDI (device driver interface (see JP 2002-91428A)) function.

3-2-2 Printer Driver 153

The printer driver 153 has a conversion processing section for converting image data into printing data of each of the component colors, a detection processing section for detecting the gradation values and the image forming ratio of the printing data of each of the component colors, a determination processing section for determining the adjustment value of the line period of each line of the thermal head 40 and a transmission processing section for transmitting the folder containing the printing data, the attribute information, the recording data and so on to the printing apparatus 1.

Figure 8:
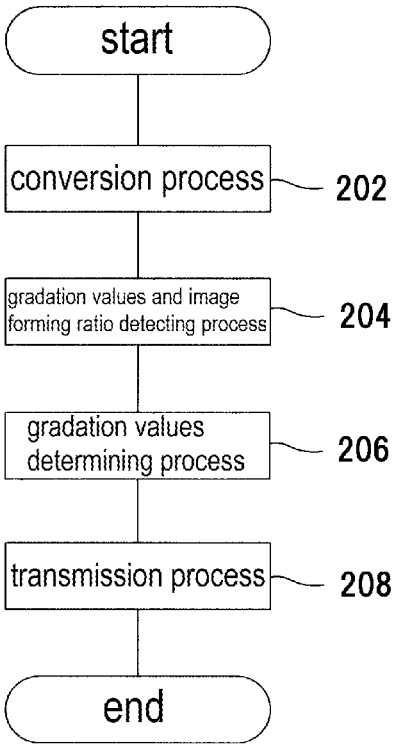
FIG. 8 is a flowchart of the processing routine of the printer driver that the CPU of the control section of the host device executes.

FIG. 8 is a flowchart of the processing routine of the printer driver that the CPU of the control section 150 executes. The conversion processing section executes the conversion process of Step (to be abbreviated as "S" hereinafter) 202 and the detection processing section executes the gradation values and image forming ratio detecting process of S204, while the determination processing section executes the adjustment value determining process of S206 and the transmission processing section executes the transmission process of S208, the CPU taking a major role in the above-described processes. Now, the processes that the above-described sections respectively execute will be described below.

(1) Conversion Processing Section

The conversion processing section executes roughly speaking two different conversion processes on the image data out of the data contained in the folder it receives from the object generating section 152 (GDI).

The first conversion process is a mirror image conversion process of converting image data into a mirror image. Note that the mirror image conversion process may not necessarily be executed by the (conversion processing section of) the host device 101 and, alternatively, the printing apparatus 1 may execute a mirror image conversion process on the printing data for each of the component colors.

The second conversion process actually includes the following three image conversion processes to be executed on the image data obtained as a result of the mirror image conversion process. Note that, in this embodiment, each of the pixels to be used for the printing data of Y, M, C and Bk is converted by means of 256 gradations within the range of 0 to 255 gradation values.

1) Conversion of image data containing the component colors of R (red), G (green) and B (blue) as image components into printing data containing the component colors of Y, M and C 2) Conversion (correction) that is arbitrarily executed at the time of the above conversion of 1), which may typically be any of the following.

(a) Gamma conversion (where the user arbitrarily adjust the tint in a manner the user likes [see, JP 08-80640A] for detail).

(b) Linear conversion (of correcting the coloring characteristics of the printing apparatus 1 (the output-printing density to the thermal head 40 [see, JP 06-30271A] for detail).

(c) Environment correction (of correcting the color characteristics attributable to the environment of the thermal head and the temperature in the printing apparatus 1 [see, JP 63-115766A for detail).

(d) Edge enhancing conversion (of enhancing, for example, the contour of a face [see, JP 2007-320050A for detail)

(e) Head resistance correction (of correcting the coloring characteristics of the thermal head 40 attributable to the structure thereof [see, JP 07-125284A] for detail).

Note that, when any of the conversions (corrections) (c) through (e) is executed, the execution will be realized after preliminarily acquiring predetermined pieces of information (such as the environmental temperature) on the printing apparatus 1 by way of the communication section 155.

3) Dither conversion (conversion-related dithering) relative to image data having Bk (black) as component color. Such a dither conversion is executed when the ink of the Bk ink panel of the ink ribbon 41 is thermofusible ink as in the instance of this embodiment. However, a dither conversion is also executed relative to the inks of the color ink panels when the inks of the color ink panels of the ink ribbons 41 are thermofusible inks (unlike this embodiment).

(2) Detection Processing Section

Figure 5B:
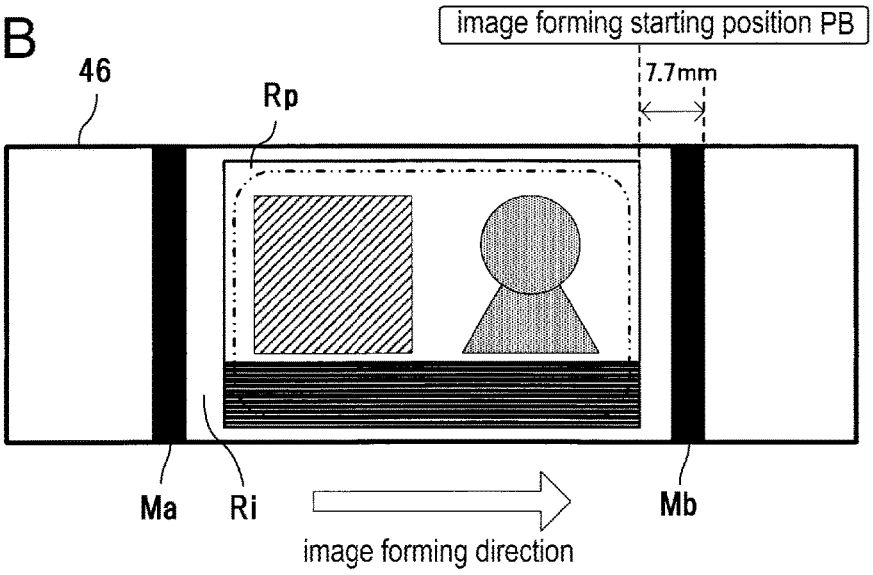
Figure 10:
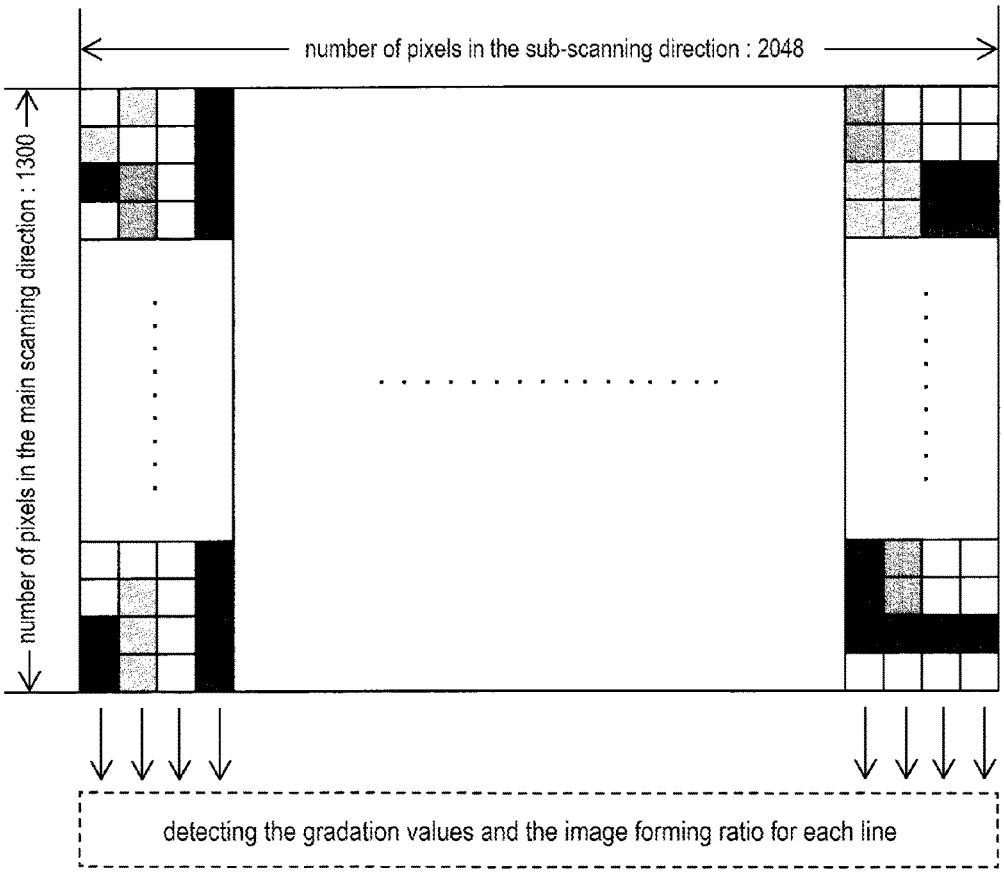
FIG. 10 is a schematic illustration of the operation of detecting the gradation values and the image forming ratio of each pixel group corresponding to a line in the main scanning direction of the thermal head as contained in the printing data, the operation being executed by the control section of the host device.

FIG. 10 is a schematic illustration of the pixels of the printing data of a single color (e.g., Y) that correspond to the printing region Rp of the thermal head 40 shown in FIGS. 5A and 5B. In this embodiment, each set of printing data involves the use of 1,300 pixels in the main scanning direction that correspond to the number of heating elements of the thermal head 40 as viewed in the main scanning direction and 2,048 pixels in the sub-scanning direction.

The detection processing section detects the gradation values and the image forming ratio for each pixel group that corresponds to a line in the main scanning direction of the thermal head 40 as shown in FIG. 10 on the printing data of each of the component colors of Y, M and C obtained as a result of the conversion processes executed by the conversion processing section. Note that, in this embodiment, since the number of pixels that can be used for image formation for each pixel group for the printing data corresponding to a line in the main scanning direction of the thermal head 40 is 1,300, the image forming ratio is the ratio of the pixels having a gradation value of not smaller than 1 out of the pixels of the pixel group for the printing data corresponding to a line relative to 1,300.

(3) Determination Processing Section

The determination processing section determines the adjustment value of the line period of each line of the thermal head 40 in response to the gradation values and the image forming ratio of each pixel group that correspond to a line as detected by the detection processing section.

Firstly, the determination processing section computationally determines the elongation coefficient for each image formation by Y, M or C ink for each line by referring to the table 1 shown below (and executing a calculation of proportional division) according to the gradation values and the image forming ratio of each pixel group that corresponds to a line for each of the lines in the printing data of Y, M and C. As for the gradation values, a greater gradation value may be weighted high if compared with a smaller gradation value because a greater gradation value exerts a greater influence to elongation in view of the average gradation value of each pixel of the pixels of each pixel group that corresponds to a line. Note that the following description of this embodiment is based on an assumption that, when all the elongation coefficients of all the lines (2,048 lines) are equal to 1.0, the image forming region Ri is elongated by 1.0 [mm]. In other words, when the elongation coefficient of a line is equal to 1.0, the line is presumably elongated by about 1/2048 mm, or 0.0004883 mm.

TABLE 1

| | | Gradation value | | | |
|---|---|---|---|---|---|
| | | 63 | 127 | 191 | 255 |
| Image forming ratio | 25% | 0.06 | 0.13 | 0.19 | 0.25 |
| | 50% | 0.13 | 0.25 | 0.38 | 0.50 |
| | 75% | 0.19 | 0.38 | 0.56 | 0.75 |
| | 100% | 0.25 | 0.50 | 0.75 | 1.00 |

Figure 11:
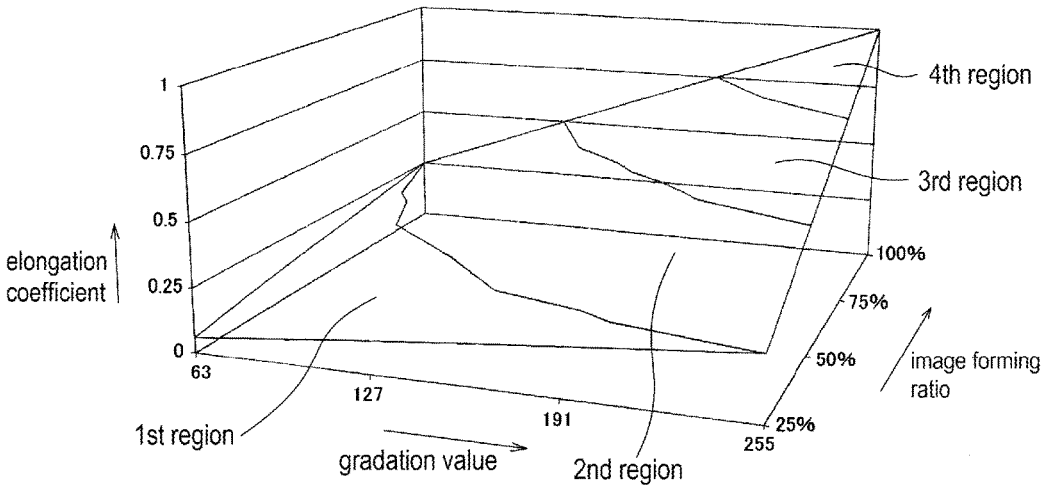
FIG. 11 is a graph schematically illustrating the relationship of gradation values, image forming ratios and elongation coefficients.

FIG. 11 shows a schematic graph of elongation coefficient, in which the X-axis indicates the gradation value and the Y-axis indicates the image forming ratio to make the Z-axis indicate the elongation coefficient. For example, as shown in the fourth region in FIG. 11, when the gradation value is large in the pixel group of a line (e.g., 265 gradations) and the image forming ratio is also large (e.g., 100%), the film 46 is elongated to a large extent to accordingly give rise to a large elongation coefficient (e.g., elongation coefficient=1). Conversely, as shown in the first region in FIG. 11, when the gradation value is small (e.g., 63 gradations or less) and the image forming ratio is also small (e.g., not greater than 25%), the film 46 is elongated only to a small extent to accordingly give rise to a small elongation coefficient (e.g., elongation coefficient=0.06).

Then, the determination processing section computationally determines (the estimate value of) the elongation that arises in the image forming region Ri in the image forming operation for a line for each of Y, M and C by referring to the predetermined relationship between the calculated elongation coefficient and (the estimate value of) the elongation [mm] that arises in the image forming region Ri in the operation of forming an image of a line in the printing region Rp.

The elongations of Y, M and C may differ from each other depending on the degree of sublimation of the ink panel of the ink ribbon 41 of each of the colors and the ink receiving capacity of the ink receiving layer of the transfer film 46 so that the above-described relationship formula or table can be prepared by acquiring the actually measured elongation values observed in the printing apparatus 1 placed in a thermostatic chamber in an environment where the temperature is held to a reference temperature (e.g., room temperature). At this time, the accuracy of the actually measured values can be improved by printing the printing data of a line for 1,000 times, measuring elongations thereof and defining the elongation of a line as 1/1,000 of the obtained elongations.

Subsequently, the determination processing section executes a temperature-based correction on the elongation for a line for each of Y, M and C according to the temperature detected by the temperature sensor Th. Such a temperature-based correction is also executed by referring to the predetermined relationship formula or table for the elongation and the temperature. Such a temperature-based correction formula or table can be prepared by actually measuring the elongations in the printing apparatus 1 placed in a thermostat chamber in an environment where the temperature is made to rise typically by 10° C. at a time so as to make the temperature rise cross the reference temperature (e.g., room temperature) and acquiring the measured values. Note that the temperature-based corrections are conducted after acquiring the environment temperature of the printing apparatus 1 by way of the communication section 155. Also note that the determination processing section may not necessarily execute such temperature-based corrections and the elongations observed at different environment temperatures may be corrected to the elongation observed at the reference temperature. If such is the case, the printing apparatus 1 may execute temperature-based corrections relative to the adjustment values, which will be described hereinafter.

Subsequently, the determination processing section determines the adjustment value of the line period of the thermal head 40 for each line in the printing data of each of the component colors in anticipation of the elongation that arises to the printing region Rp for each line and according to the predetermined relationship between the elongation of the printing region Rp and the adjustment value of the line period for each line. If, for example, the elongation coefficient of a line is equal to 1.0 and the line is printed without adjustment, the line will be elongated by 0.0004883 mm. Then, the line length needs to be adjusted from 0.0427734 mm (86.6/2048+0.0004883 mm) to 0.422851 mm (86.6/2048 mm). Differently stated, the line period needs to be adjusted and reduced in order to make the elongation equal to nil. In this instance, it needs to be so determined that the line period is reduced by −1.15478% (adjustment value: −1.15478%). According to this determination, the printing apparatus 1 adjusts (corrects) the line period to 0.8 [ms/line×0.9884511=0.79076 ms/line] from the reference line period of the thermal head 40 of 0.8 [ms/line].

The step by step procedure for determining the adjustment value of the line period by the determination processing section is described above. In actuality, however, the determination processing section directly calculates the adjustment value of the line period per line by using the gradation values and the image forming ratio of each line detected by the detection processing section in the above-described mathematical formula.

Additionally, the determination processing section determines the adjustment value of the line period of the thermal head 40 that corresponds to the estimated elongation of the printing region Rp per line and, at the same time and in parallel with the above determination, also determines the adjustment value of the image forming starting position for M ink from the estimated elongation of the image forming region Ri that arises when all the lines are printed with Y ink. Additionally, the determination processing section determines the adjustment value of the image forming starting position PA for C ink from the estimated elongation of the image forming region Ri that arises when all the lines are printed with Y ink and also with M ink. In other words, the image forming starting position PA of a given color is modified by the estimated elongation of the image forming region Ri that has arisen by the printing operation or operations of the preceding color or colors. Note that the estimated elongation at the time of printing all the lines can be calculated as the total sum of the estimated elongations that are determined by the above-described elongation coefficient of a line. If the elongation coefficients of all the lines are equal to 1.0 as described above, the estimated elongation of all the lines is 1.0 mm.

The determination processing section determines the adjustment value of the image forming starting position PA in the following manner. For easy understanding, an assumption that the estimated elongation that arises to the image forming region Ri in the image forming operation (of all the lines) in the printing region Rp with Y ink is 1.0 mm, that the estimated elongation that arises to the image forming region Ri in the image forming operation in the printing region Rp with M ink is 0.5 mm and that the estimated elongation that arises to the image forming region Ri in the image forming operation in the printing region Rp with C ink is 0 mm is adopted in the following description.

As described earlier by referring to FIG. 5A, the image forming starting position PA for the image forming operation with Y ink is located at a position separated from the front end of the mark Ma by 90.3 mm because an unused image forming region Ri is employed for the operation Since an elongation of 1.0 mm has occurred to the image forming region Ri due to the image forming operation in the printing region Rp with Y ink, the image forming starting position PA for the image forming operation with M ink is corrected to a position separated from the front end of the mark Ma by 90.3 mm+1.0 mm=91.3 mm, which is a position moved by 1.0 mm from the mark Ma toward the mark Mb.

Since elongations of 1.0 mm and 0.5 mm have occurred to the image forming region Ri due to the image forming operations in the printing region Rp with Y ink and M ink, the image forming starting position PA for the image forming operation with C ink is corrected to a position separated from the front end of the mark Ma by 90.3 mm+1.0 mm+0.5 mm=91.8 mm (a position moved by 1.5 mm from the mark Ma toward the mark Mb). Since no elongation presumptively has occurred to the image forming region Ri due to the image forming operation in the printing region Rp with C ink, the image forming starting position PA for the image forming operation with Bk ink is corrected to a position separated from the front end of the mark Ma by 90.3 mm+1.0 mm+0.5 mm+0 mm=91.8 mm (a position moved by 1.5 mm from the mark Ma toward the mark Mb) just as in the case of the image forming starting position PA for image forming operation with C ink. In short, the image forming starting position PA is corrected according to the estimated elongation of the image forming region Ri and moved toward the mark Mb.

While the determination processing section determines the adjustment value for adjusting the line period of the thermal head 40 in order to keep the image length in the printing region Rp to a constant value (86.6 mm) in the above description, alternatively, the determination processing section may determine the adjustment value for adjusting not the line period but the conveyance speed of the transfer film 46 (the adjustment value for the conveyance speed of the transfer film 46 per line).

For example, if the elongation coefficient of a target line is 1.0 mm and the image forming region Ri of the transfer film 46 has been elongated, the length of the printing region Rp can apparently be held to 86.6 mm without modifying the line period by reducing the conveyance speed of the transfer film by 1.15478% from the above-described reference conveyance speed (with an adjustment value of −1.15478%), namely by reducing the conveyance speed from 0.8 ms to 0.79076 ms.

Thus, with the above-described arrangement, if elongation arises to the printing region Rp in the sub-scanning direction of the thermal head 40 at the time of forming an image in the printing region Rp by means of the thermal head 40 on a line-by-line basis, the printing region Rp can be handled as apparently showing no elongation in the sub-scanning direction of the thermal head 40.

Then, the determination processing section contains the attribute information and the recording data received from the object generating section 152, the printing data of Y, M, C and Bk obtained as a result of the converting processes executed by the conversion processing section and also the adjustment values of the line period per line of the printing data of Y, M and C (the adjustment values of the conveyance speed in the folder when adjusting the transfer film conveyance speed) and the adjustment values of the image forming starting position PA for respective colors in a folder.

(4) Transmission Processing Section

The transmission processing section transmits the folder prepared by the determination processing section according to the instruction given from the operator to the printing apparatus 1. At this time, the folder prepared according to the instruction given from the operator may also be stored in data storage section 154.

3-3 Operation of Printing Apparatus 1

Now, the card issuing operation of the printing apparatus 1 will be described mainly in terms of the CPU of the MCU 72 (to be simply referred to as CPU hereinafter) by referring to a flowchart. To simplify the following description, it is assumed here that the members of the printing apparatus 1 are positioned to their respective home (initial) positions (see FIG. 2 showing such a condition), that the initialization process of developing the programs and the program data stored in the ROM into the RAM has been completed and that the printing apparatus 1 has received the above-described folder from the host device 101 (the communication section). Additionally, since the operation of the printing section B (the image forming section B1 and the transfer section B2) is already described above, it will be described only briefly in order to avoid duplicated explanation.

Figure 12:
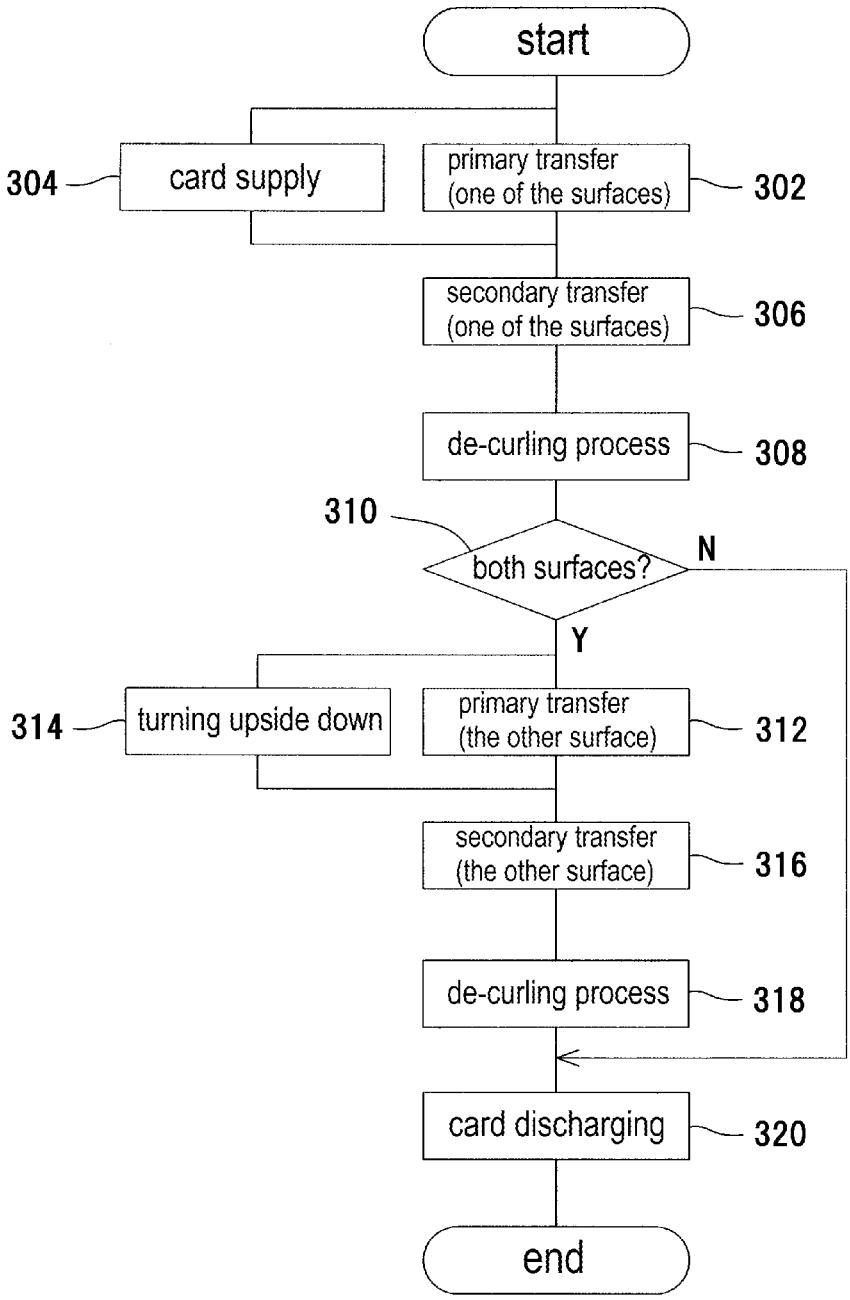
FIG. 12 is a flowchart of the card issuance routine that the CPU of the microcomputer unit (MCU) of the control section of the printing apparatus executes.

As shown in FIG. 12, with the card issuance routine, the image forming section B1 executes the primary transfer process (image forming process) of forming an image on one of the surfaces (e.g., the front surface) of the transfer film 46 in S302. More specifically, Y, M, C and Bk images are formed in an overlapping manner in the image forming region Ri of the transfer film 40 respectively with Y, M, C and Bk inks of the ink ribbons 41 by controlling the thermal head 40 of the forming section B1 according to the printing data of Y, M, C and Bk stored in the memory 77.

At this time, the CPU drives the thermal head 40 to operate to print an image from the adjusted image forming starting position by selectively heating the heating elements arranged in row in the main scanning direction and outputting the printing data and the adjustment value of the line period for each line to the thermal head control section 105 (the head control IC) by referring to the printing data, the adjustment value of the line period (the adjustment value of the conveyance speed in the folder when the film conveyance speed is to be adjusted) and the adjustment value of the image forming starting position PA in the folder stored in the memory 77.

In parallel with the primary transfer process in S302, in S304, the CPU feeds out a card Ca from the medium supply section C, executes a recording process on the card Ca by means of one or more than one of the magnetic recording section 24, non-contact type IC recording section 23 and the contact type IC recording section 27 belonging to the information recording section A according to the recording data in the folder stored in the memory 77 and subsequently conveys the card Ca to the transfer section B2.

In the next S306, the CPU executes a secondary transfer process of transferring the image formed on the transfer surface of the transfer film 46 onto one of the surfaces of the card Ca at the transfer section B2. Note that, prior to the secondary transfer process, the CPU operates to control the temperature of the heater of the heat roller 33 so as to make it get to the predetermined temperature and, at the same time, control the card Ca so as to make it get to the transfer section B2 in synchronism with the image formed on the transfer surface of the transfer film 46.

In the next S308, the CPU executes a de-curling process of correcting the warp that may have arisen to the card Ca by driving the eccentric cam 36 to rotate and press down the de-curling unit 34 toward the de-curling unit 35 so as to cause the card Ca to be sandwiched between the de-curling units 34 and 35.

In the following S310, the CPU judges if the current printing process is for double-sided printing or not according to the attribute information in the folder stored in the memory 77 and, if it judges that the current printing process is not for double-sided printing, the CPU proceeds to S320. If, on the other hand, the CPU judges that the current printing process is for double-sided printing, the CPU executes in S312 the primary transfer process of forming the image to be transferred onto the other surface (e.g., the rear surface) of the card Ca in the immediately succeeding image forming region Ri of the transfer film 46 at the image forming section B1 as in S302. Then, the CPU proceeds to S316.

In parallel with the primary transfer process in S312, the CPU conveys in S314 the card Ca pinched by the conveyance roller pair 37 and 38 and located at the de-curling mechanism 12 to the rotary unit F by way of the horizontal medium conveyance routes P2 and P1 and causes the card Ca pinched by the roller pairs 20 and 21 at the opposite ends thereof to be turned by 180° (upside down). In the next S316, the CPU executes a secondary transfer process of transferring the image formed in the immediately succeeding image forming region Ri of the transfer film 46 onto the other surface of the card Ca as in S306.

In the next S318, the CPU executes a de-curling process of correcting the warp that may have arisen to the card Ca by causing the card Ca to be sandwiched between the de-curling units 34 and 35 as in S308. Then, in the next S320, the CPU discharges the card Ca toward the storage stacker 60 to end the card issuance routine.

While the line period of the thermal head 40 or the conveyance speed of the transfer film 46 is adjusted in order to adjust the image length of the image to be formed in the image forming region Ri in the above description of this embodiment, the adjustment of the line period of the thermal head 40 and that of the conveyance speed of the transfer film 46 may be combined to make the length of the printing region Rp (the length of the thermal head 40 in the sub-scanning direction) to be equal to 86.6 mm if the image forming region Ri is elongated.

While the mark Ma located upstream relative to the image forming region Ri as viewed in the image forming direction is employed to place the transfer film 46 at the time of placing the image forming region Ri at its cue position (and determining the image forming starting position PA) in this embodiment as shown in FIG. 5A, the mark Mb located downstream relative to the image forming region Ri may alternatively be employed to place the image forming region Ri at its cue position.

FIG. 5B schematically illustrates the image forming starting position relative to the image forming region Ri of the transfer film 46 in the image forming section B1 when the mark Mb located at a position downstream relative to the image forming region Ri as viewed in the image forming direction is employed to place the transfer film 46 in its initial position. As shown in FIG. 5B, when the mark Mb is employed to place the transfer film 46 in its initial position, the image forming starting position PB in the image forming region Ri is separated from the front end of the mark Mb (as viewed in the printing direction) by 7.7 mm. In this instance, if the image forming region Ri of the transfer film 46 is elongated as a result of printing an image with Y color ink, all the positions between the mark Mb and the image forming starting position Pb are not shifted at all so that it is not necessary to adjust the image forming starting positions for printing images with inks of the remaining colors. Thus, in this embodiment, since the distance from the mark Mb to the image forming starting position and the length of the printing region Rp are not altered, the transfer starting position in the transfer section B2 does not need to be adjusted.

While either the line period of the thermal head 40 or the conveyance speed of the transfer film 46 for a line is modified in order to adjust the length of the image to be formed in the image forming region Ri of this embodiment in the above description, it may alternatively be so arranged that a single adjustment value is employed for all the lines on the basis of the total sum of the estimated elongations of all the lines (or the average of the elongation coefficients of all the lines).

Second Embodiment

Now, the second embodiment of printing system 100 included of a printing apparatus according to the present invention and a computer will be described below. In the printing system 100 of the second embodiment, the adjustment value determining process (see S206 in FIG. 8) as described above for the first embodiment is executed by the printing apparatus 1. Note that all the members of the printing system 100, the functional sections and the processing steps of the second embodiment that are the same as those of the first embodiment are respectively denoted by the same reference symbols and will not be described any further. In other words, only the components that are different from those of the first embodiment will be described below.

Figure 13A:
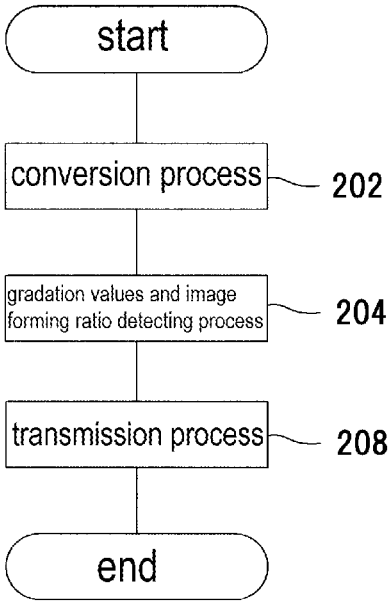
FIGS. 13A and 13B are flowcharts of the printing system of the second embodiment of the present invention.

The printer driver 153 of the host device 101 has a conversion processing section (see also S202 in FIG. 13A), a detection processing section (see also S204 in FIG. 13A) and a transmission processing section (see also S208 in FIG. 13A) but does not have a determination processing section that the printer driver 153 of the above-described first embodiment has. For this reason, the detection processing section stores the attribute information and the recording data it receives from the object generating section 152, the Y, M, C and Bk printing data obtained as a result of conversions executed by the conversion processing section and the gradation values and the image forming ratios of all the lines it has detected into a single folder and the transmission processing section transmits the folder prepared by the detection processing section to the printing apparatus 1 according to the instruction given from the operator.

Figure 13B:
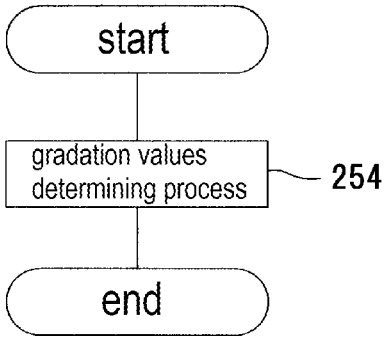

On the other hand, the CPU (of the printing apparatus 1) receives the above-described folder from the host device 101 (the communication processing section) and subsequently executes the adjustment value determination routine shown in FIG. 13B before it executes the card issuance routine shown in FIG. 12. More specifically, in S254, the CPU executes a process similar to the process executed by the determination processing section of the printer driver 153 of the host device 101 as described above for the first embodiment by referring to the printing data in the folder that is stored in the memory 77 and stores the adjustment values of the line periods of all the lines of the printing data for each of the component colors and the adjustment values of the image forming starting position PA in the folder stored in the memory 77. Note that the environment temperature detected by the temperature sensor Th is employed in S254.

Third Embodiment

Now, the third embodiment of printing system formed by a printing apparatus according to the present invention and a computer will be described below. The printing system 100 of the third embodiment differs from the first embodiment in that the printing apparatus 1 executes the process of detecting the gradation values and the image forming ratios (see S204 in FIG. 8) and the adjustment value determining process (see S206 in FIG. 8) described above for the first embodiment.

Figure 14A:
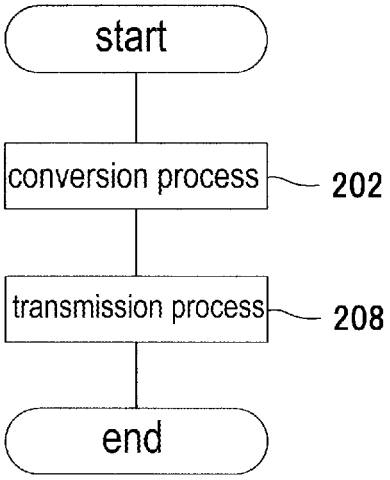
FIGS. 14A and 14B are schematic flowcharts of the printing system of the third embodiment of the present invention.

The printer driver 153 of host device 101 has a conversion processing section (see also S202 in FIG. 14A) and a transmission processing section (see also S208 in FIG. 14A) but does not have a detection processing section and a determination processing section that the printer driver 153 of the above-described first embodiment has. For this reason, the conversion processing section stores the attribute information and the recording data it receives from the object generating section 152 and the Y, M, C and Bk printing data obtained as a result of conversions in a single folder and the transmission processing section transmits the folder prepared by the conversion processing section to the printing apparatus 1 according to the instruction given from the operator.

Figure 14B:
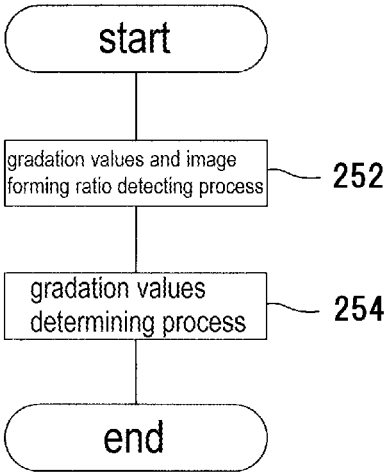

On the other hand, the CPU (of the printing apparatus 1) receives the above-described folder from the host device 101 (the communication processing section) and subsequently executes the adjustment value determination routine shown in FIG. 14B before it executes the card issuance routine described above by referring to FIG. 12. More specifically, in S252, the CPU executes a process similar to the process executed by the detection processing section of the printer driver 153 of the host device 101 as described above for the first embodiment by referring to the printing data in the folder stored in the memory 77 and, in the next S254, the CPU executes a process similar to the process executed by the determination processing section of the printer driver 153 of the host device 101 as described above for the first embodiment. Then, the CPU stores the adjustment values of the line periods of all the lines of the printing data (or the adjustment values of the conveyance speeds) for each of the component colors and the adjustment values of the image forming starting position PA into the folder stored in the memory 77. Note that the environment temperature detected by the temperature sensor Th is employed in S252 (for the conversions (c) through (e) out of the conversions executed arbitrarily by the conversion processing section) and also in S254.

(Modification 1)

While adjustment operations of making the image length in the printing region Rp shows a constant value are executed in the above-described embodiments, it may alternatively be so arranged that the phenomenon that the image forming region Ri is elongated as a result of an image forming operation in the printing region Rp by the thermal head 40 is accepted as inevitable and then measures are taken to prevent any color shift from taking place.

As the image forming region Ri of the transfer film 46 is elongated as a result of image formation in the printing region Rp by the thermal head 40, using ink of the first component color (e.g., Y), the distance from the mark Ma to the image forming starting position PA is altered (see also FIG. 5A) so that the image forming starting position PA for ink of the second component color (e.g., M) is displaced to give rise to a color shift at the image forming starting position. Additionally, as the image forming region Ri is elongated, color shift also occurs at the image forming ending position. For this reason, both (1) adjustment (correction) of the image forming starting position PA and (2) adjustment (correction) of the image length in the printing region Rp become necessary in response to the elongation of the image forming region Ri. Since adjustment of the image forming starting position PA of this modification 1 is the same as that of the above-described first embodiment, it will not be described here repeatedly.

Furthermore, when the printing region Rp is elongated, the longitudinal center Cn of the printing region Rp as viewed in the image forming direction and the longitudinal center of the card Ca no longer agree with each other. For this reason, (3) adjustment (correction) at the transfer section B2 also becomes necessary.

(2) Adjustment of Image Length in Printing Region Rp

The image length in the printing region Rp of the thermal head 40 is adjusted by modifying the line period of the thermal head 40 according to the detected elongation coefficient as in the above-described first embodiment. Note, however, while the line period is reduced in the first embodiment, the line period is increased in this embodiment. Also note that, in this embodiment, the elongation coefficient is determined on the basis of the gradation values of the same line printed with the immediately preceding component color and the line period is adjusted according to the elongation coefficient.

Assume here, for example, when a given line is printed with Mink, an elongation coefficient of 1.0 was determined as a result of detection of the gradation values of the line at the time of printing the same line with Y ink. In such an instance, it is estimated that the line will be elongated by $1/2048$ or by about 0.0004883 [mm] as described above for the first embodiment. Thus, at the time of printing the line with M color ink, the length of the line needs to be adjusted from 0.0422851 mm (86.6/2048 mm) to 0.0427734 mm. For this reason, the determination processing section determines an adjustment value so as to multiply the line period by 1.0115478 (an adjustment value of +1.15478%) and modify the line period of 0.8 [ms/line] to 0.8092382 [ms/line] when printing the line with M color ink. Then, when printing the line with C color ink, the determination processing section adjusts the line period so as to extend the line period on the basis of the estimated elongation values produced as a result of the printing operations by Y color ink and M color ink (the sum of the elongation coefficient of Y and that of M).

In an instance where the line period of the thermal head 40 is adjusted so as to be elongated according to the result of the printing with the immediately preceding color, no adjustment operation is required for the printing operation using the first color, which is the color of Y ink, although, alternatively, the line period may be adjusted so as to be reduced according to the detected elongation coefficient for the printing operation using Y ink and, if nevertheless elongation occurs, the line period may be adjusted so as to be elongated at the time of the printing operation using M ink and also at the time of printing operation using C ink. If such is the case, the elongation coefficient for M ink and the elongation coefficient for C ink need to be reduced according to the adjustment value for Y ink.

(3) Adjustment of Transfer Starting Position

Figure 6B:
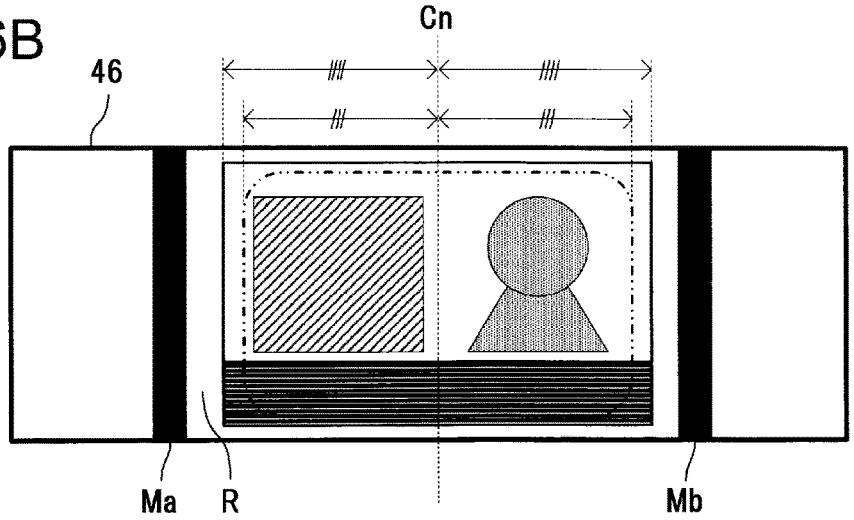

FIG. 6B schematically illustrates the operation of aligning the printing region Rp and the card Ca when elongation has occurred to the printing region Rp of the transfer film 46. In the following description it is assumed that the printing region Rp of this embodiment is estimated to be elongated by 1.5 mm as a result of image forming operations using Y, M and C inks (the final elongation is estimated to be 1.5 mm as a result of detection of the gradation values and the image forming ratios).

In such an instance, the transfer section B2 is required to adjust (correct) the elongation of the printing region Rp for ½ (1.5 mm/2=0.75 mm) of the elongation that has occurred to the printing region Rp. More specifically, the position of the transfer film 46 that is reached when the transfer film 46 is conveyed by 30 mm+0.75 mm=30.75 mm after the detection of the mark Mb by the sensor Se3 is defined as the transfer starting position. Then, as a result, if the printing region Rp has been elongated, the center Cn of the image length of the printing region Rp in the image forming direction can be made to agree with the center of the card Ca in the longitudinal direction thereof to make it possible to prevent an phenomenon where the image transferred onto the card Ca appears to be displaced to a side (which may be easily noticeable when an ID photo or a logo is arranged at an end of the card Ca) and, in extreme instances, a part of the image on the card Ca located at the image transfer leading edge is cut away can be prevented from taking place.

Note that Bk ink of this embodiment is thermofusible ink and any possible elongation caused by using such Bk ink does not need to be taken into consideration because thermofusible ink is less liable to be absorbed by the ink receiving layer of the transfer film 46 if compared with sublimation ink (so that more liable to adhere to the ink receiving layer) and hence elongation due to the use of Bk ink, if any, is very small.

In the primary transfer process at S302 and S312 shown in FIG. 12, the CPU executes (1) the adjustment operation of adjusting the image forming starting position PA and (2) the adjustment operation of adjusting the printing region Rp. In the secondary transfer process at S306 and S316, the CPU executes (3) the above-described adjustment operation of adjusting the transfer starting position.

On the other hand, at the host device 101, the determination processing section of the printer driver 153 computationally determines the elongation of the image length in the printing region Rp per line and subsequently calculates the total sum of the elongations for the printing data of all the lines. Then, the determination processing section determines the adjustment value of the line period of the thermal head 40 according to the predetermined relationship between the total sum of the elongations of the printing region Rp of all the lines and the adjustment value of the line period. Additionally, the determination processing section determines the above-described (1) the adjustment value of the image forming starting position PA, (2) the adjustment value of the image length in the printing region Rp of the thermal head 40 and (3) the adjustment value of the transfer starting position.

Then, the determination processing section stores the attribute information and the recording data it receives from the object generating section 152, the printing data of Y, M, C and Bk obtained as a result of the converting operations by the conversion processing section and the above-described adjustment values of (1), (2) and (3) of the printing data of Y, M and C into a single folder.

Note that, if the mark Mb located downstream relative to the image forming region Ri is employed for detecting the initial position, the distance from the mark Mb to the image forming starting position PB is not altered at all even when the image forming region Ri of the transfer film 46 is elongated. Therefore, (1) the above-described adjustment of the image forming starting position PB is not necessary. Thus, the determination processing section determines only the above-described adjustment values of (2) and (3).

Also note that the determination processing section determines the adjustment value of the line period of the thermal head 40 according to the elongation of the printing region Rp that arises as a result of the printing operation using the immediately preceding ink in the above description. However, the determination processing section may alternatively determine the adjustment value of the conveyance speed of the transfer film 46 (the adjustment value of the conveyance speed of the transfer film 46 per line) without modifying the line period.

For example, if the elongation coefficient of a given line printed with Y ink is 1.0 mm, the color shifts due to the differences in the elongation of the printing region Rp attributable to the inks of different colors can be minimized by increasing the conveyance speed of the transfer film 46 by 1.15478% relative to the above-described reference conveyance speed (with an adjustment value of +1.15478%) to make the conveyance speed of the transfer film 46 to be equal to 0.8092382 ms without changing the line period of 0.8 ms/line for the printing operation of the line, using M ink.

While either the line period of the thermal head 40 or the conveyance speed of the transfer film 46 is adjusted in order to adjust the image lengths of the images to be formed in the image forming region Ri in the above description of this embodiment, adjustment of the line period of the thermal head 40 and that of the conveyance speed of the transfer film 46 may be combined to adjust the image lengths according to the elongations of the printing region Rp that arise due to the printing operations of different inks of the component colors in order to eliminate the color shifts among the different colors.

While either the line period of the thermal head 40 or the conveyance speed of the transfer film 46 is modified for each line in order to adjust the image lengths of the images to be formed in the image forming region Ri in the above description of the embodiment, a single adjustment value may be determined for all the lines on the basis of the sum of the estimated elongations of all the lines (or the average value of the elongation coefficients of all the lines).

While the differences between this embodiment (modification 1) and the first embodiment are described above, color shifts can be prevented from taking place in the second and third embodiments, while accepting elongations of the printing region Rp as inevitable as a result of the operations of forming images in the printing region Rp by means of the thermal head 40, also by taking the above-described differences into consideration.

4. Advantages and Other Features

Now, the advantages and other features of the printing systems 100 of the above-described embodiments will be described below.

4-1 Advantages

The printing systems 100 of the first through third embodiments can prevent color shifts from taking place regardless of the elongations that arise to the transfer film 46 as the transfer film 46 is heated by the thermal head 40 because the image length of the image formed by means of the printing data of each of the component colors on the transfer film 46 and the thermal head 40 is adjusted for each line according to the gradation values and the image forming ratio of each pixel group of the printing data that correspond to a line in the main scanning direction of the thermal head 40 and the image lengths of the images in the printing region Rp are held to a constant value (86.6 mm).

The printing system 100 of the modification 1, on the other hand, can prevent any color shift from taking place regardless of the elongations that arise to the transfer film 46 as the transfer film 46 is heated by the thermal head 40 because the elongation that occurs to the transfer film 46 due to the heating by the thermal head 40 at the time of forming an image by means of ink of one of the component colors (e.g., Y) is utilized to adjust the line period of the thermal head 40 for all the lines for the operation of forming an image by each of the succeeding component colors including the immediately succeeding component color (e.g., M) (and hence adjust the image length of the image in the printing region Rp) and, at the same time, both the image forming starting position PA and the transfer starting position are adjusted.

Therefore, in each of the printing systems 100 of the embodiments and the modification 1 as described above, the amount of heat generated per unit time by the thermal head 40 can be raised to reduce the time required to form an image without sacrificing the quality of the images formed on the transfer film 46 (and the image formed on a card Ca).

4-2 Modifications

While the embodiments of the present invention are described above in terms of indirect printing type printing apparatus 1, the present invention is by no means limited to the use of such a printing apparatus and the present invention is also applicable to the use of direct printing type printing apparatus that directly print images on cards Ca by means of ink ribbons 41. When an indirect printing type printing apparatus is employed, it is only necessary to appropriately change the configuration and the position of the image forming section, those of the conveyance roller and those of the sensor and so on. While a transfer film 46 is employed as medium in each of the above-described embodiments, the present invention is also applicable to thermally expandable tubes and films when a direct printing type printing apparatus is employed.

While color ink of Bk is employed in addition to Y, M and C inks in each of the above-described embodiments, the present invention is by no means limited to the use of Bk ink and ink of some other color (e.g., gold or silver) may alternatively be employed. Furthermore, the image length obtained from the printing data of Bk or some other color may also be adjusted according to the gradation values and the image forming ratios for the image forming operation using ink of that color just as in the case of using the printing data of Y, M and C for image forming operations.

While the printing data of each of the component colors are converted (generated) from the image data by the host device 101 in each of the above-described embodiments, the present invention is by no means limited to such an arrangement and it may alternatively be so arranged that the printing apparatus 1 (CPU) generates printing data of each the component colors from the input image data and stores the printing data in the memory 77.

While the platen roller 45 is pressed against and held in contact with the thermal head 40 at the image forming section B1 in each of the above-described embodiments, it may alternatively be so arranged that the thermal head 40 is pressed against and held in contact with the platen roller 45. Then, the platen roller 45 may not necessarily be the illustrated one, although the adopted platen roller 45 preferably does not adversely affect conveyances of the transfer film 46 and the ink ribbons 41. Additionally, while the heat roller 33 is pressed against and held in contact with the platen roller 31 at the transfer section B2 in each of the above-described embodiments, conversely the platen roller 31 may be pressed against and held in contact with the heat roller 33.

Furthermore, while an image is formed in the image forming region Ri of the transfer film 46 at the image forming section B1 so as to be transferred onto one of the surfaces of the card Ca (Step 302 in FIG. 12), the image is actually transferred onto one of the surfaces of the card Ca at the transfer section B2 (Step 306), subsequently the card Ca is conveyed to the rotary unit F so as to be turned by 180° there (Step 314) in parallel with the operation of forming an image in the succeeding image forming region Ri of the transfer film 46 at the image forming section B1 so as to be transferred onto the other surface of the card Ca (Step 312) and the image is actually transferred onto the other surface of the card Ca at the transfer section B2 (Step 316) in each of the above-described embodiments, it may alternatively be so arranged that an image is formed in the image forming region Ri of the transfer film 46 so as to be transferred onto one of the surfaces of the card Ca, subsequently another image is formed in the succeeding image forming region Ri of the transfer film 46 so as to be transferred onto the other surface of the card Ca at the image forming section B1, then the first image is transferred onto one of the surfaces of the card Ca in the transfer section B2 and thereafter the card Ca is conveyed to the rotary unit F so as to be turned by 180° there and thereafter the second image is transferred on the other surface of the card Ca.

While the host device 101 is connected to the printing apparatus 1 in the printing system 100 in each of the above-described embodiments, the present invention is by no means limited to such an arrangement. For example, the folder prepared by the host device 101 may be delivered to the printing apparatus 1 by way of a USB memory, a memory card or the like. Furthermore, when the printing apparatus 1 is designed to operate as a constituent member of a local network, it may be so arranged that the above-described folder is transmitted to the printing apparatus 1 from a computer that is also connected to the local network. Additionally, it may be so arranged that the attribute information and the recording data as described above are input by way of the operation panel section 5.

While "a computer program, the recording medium causing a computer to operate as generation unit for generating printing data for each of the component colors from image data and also as detection unit for detecting the gradation values of the pixels of the pixel group corresponding to a line running in the main scanning direction of the thermal head and the image forming ratio representing the ratio of the number of pixels having the component color relative to the number of the pixels of the pixel group corresponding to the line in the printing data of each of the component colors generated by the generation unit" is included in the claims of the present invention, such a program can also be used, for example, to form a high quality image on the transfer film 46 by adjusting the tension to be applied to the transfer film 46 according to the gradation values and the image forming ratio in addition to adjusting the image length for an operation of forming an image on the transfer film 46 by means of the thermal head 40, using the printing data of each of the component colors. Details of such a program are disclosed in the specification of Japanese Patent Application No. 2016-249215 filed on the same priority date of this application filed by the inventors.

This patent application claims the benefit of priority of Japanese Patent Application No. 2016-249214 Application No. 2016-249215, which is incorporated herein by reference.

What is claimed is:

1. An image forming apparatus for forming images on mediums by means of ink ribbons respectively containing inks of different component colors, the apparatus comprising:

an image forming unit including a thermal head and a medium conveying section for conveying a medium;

a storage unit for storing printing data of different component colors; and a control unit for controlling the image forming unit;

the control unit adjusting the image length at the time of forming an image of each of the component colors on the medium by means of the thermal head and printing data of the component color according to the gradation values of the pixels of the pixel group corresponding to a line running in the main scanning direction of the thermal head and the image forming ratio representing the ratio of the number of pixels having the component color relative to the number of the pixels of the pixel group corresponding to the line in the printing data for the component color stored in the storage unit.

2. The image forming apparatus according to claim 1, wherein the control unit adjusts the image length at the time of forming an image of each of the component colors by means of printing data of the component color by modifying the line period of the thermal head and/or the conveyance speed of the medium by the medium conveying section.

3. The image forming apparatus according to claim 1, wherein the control unit adjusts the elongation arising to the medium for each line in the sub-scanning direction of the thermal head according to the gradation values and the image forming ratio at the time of forming an image of each of the component colors by means of printing data of the component color.

4. The image forming apparatus according to claim 1, wherein the control unit adjusts the image length at the time of forming an image of each of the component colors by means of printing data of the component color so as to make it agree with a predetermined value.

5. The image forming apparatus according to claim 1, wherein the control unit adjusts the image length at the time of forming an image of each of the component colors by means of printing data of the component color by detecting the gradation values and the image forming ratios from the printing data of each of the component colors and adjusting the image length according to the detected gradation values and the detected image forming ratios.

6. The image forming apparatus according to claim 1, wherein the control unit generates printing data of each of the component colors from the input image data and subsequently stores the generated printing data of each of the component colors in the storage unit.

7. A computer-readable recording medium storing a computer program, the recording medium causing a computer to operate as generation unit for generating printing data for each of the component colors from image data and also as detection unit for detecting the gradation values of the pixels of the pixel group corresponding to a line running in the main scanning direction of the thermal head and the image forming ratio representing the ratio of the number of pixels having the component color relative to the number of the pixels of the pixel group corresponding to the line in the printing data of each of the component colors generated by the generation unit.

8. The recording medium according to claim 7, wherein the recording medium additionally causes a computer to operate as determination unit for determining the adjustment value for the image length at the time of forming an image using printing data of each of the component colors on a medium by referring to the gradation values and the image forming ratio detected by the detection unit.

9. An image forming system including an image forming apparatus for forming an image on a medium by means of ink ribbons containing inks of different colors and a computer capable of communicating with the image forming apparatus, the system comprising:

a generation unit for generating printing data for each of the component colors from image data;

a detection unit for detecting the gradation values of the pixels of the pixel group corresponding to a line running in the main scanning direction of the thermal head and the image forming ratio representing the ratio of the number of pixels having the component color relative to the number of the pixels of the pixel group corresponding to the line in the printing data of each of the component colors generated by the generation unit; and a determination unit for determining the adjustment value for the length of the image of each component color according to the printing data of the component color at the time of forming an image on the medium by means of the thermal head by referring to the gradation values and the image forming ratio detected by the detection unit.

* * * * *